US009003936B2

(12) United States Patent
Chillman et al.

(10) Patent No.: US 9,003,936 B2
(45) Date of Patent: Apr. 14, 2015

(54) WATERJET CUTTING SYSTEM WITH STANDOFF DISTANCE CONTROL

(75) Inventors: Alex M. Chillman, Seattle, WA (US); Kirby J. Eide, Des Moines, WA (US); Bruce M. Schuman, Auburn, WA (US); Aki Tanuma, Federal Way, WA (US); Sean A. Vaughan, Maple Valley, WA (US); Raymond L. Chenoweth, II, Harrison, MI (US); Richard B. Hageman, III, Louisville, KY (US); Steven J. Craigen, Auburn, WA (US); Mohamed A. Hashish, Bellevue, WA (US); Charles D. Burnham, Southbury, CT (US)

(73) Assignee: Flow International Corporation, Kent, WA (US)

( * ) Notice: Subject to any disclaimer, the term of this patent is extended or adjusted under 35 U.S.C. 154(b) by 495 days.

(21) Appl. No.: 13/194,579

(22) Filed: Jul. 29, 2011

(65) Prior Publication Data

US 2013/0025422 A1 Jan. 31, 2013

(51) Int. Cl.

| | |
|---|---|
| ***B26D 7/00*** | (2006.01) |
| ***B24C 1/04*** | (2006.01) |
| ***B24C 5/02*** | (2006.01) |

(Continued)

(52) U.S. Cl.

CPC . *B24C 1/045* (2013.01); *B24C 5/02* (2013.01); *B24C 9/00* (2013.01); *B24C 5/00* (2013.01); *B26F 3/004* (2013.01)

(58) Field of Classification Search

CPC .. B24C 7/0053; B26D 2007/208; B26F 3/004

USPC ..... 83/168, 169, 177, 13, 22, 76.7, 285, 83/286, 289, 371

See application file for complete search history.

(56) References Cited

U.S. PATENT DOCUMENTS

| | | | | |
|---|---|---|---|---|
| 2,985,050 | A * | 5/1961 | Schwacha | 83/53 |
| 3,877,334 | A | 4/1975 | Gerber | 83/22 |

(Continued)

FOREIGN PATENT DOCUMENTS

| | | |
|---|---|---|
| DE | 40 05 453 | 8/1991 |
| DE | 100 56 329 | 7/2002 |

(Continued)

OTHER PUBLICATIONS

Optex FA Co., Ltd., Displacement Sensor CD33 Series Instruction Manual, available as early as Jun. 2011, 2 pages.

*Primary Examiner* — Sean Michalski
(74) *Attorney, Agent, or Firm* — Seed IP Law Group PLLC

(57) ABSTRACT

A cutting head of a waterjet cutting system is provided having an environment control device and a measurement device. The environment control device is positioned to act on a surface of a workpiece at least during a measurement operation to establish a measurement area on the surface of the workpiece substantially unobstructed by fluid. The measurement device is positioned to selectively obtain information from within the measurement area indicative of a position of the cutting head relative to the workpiece. A control system is further provided and operable to position the cutting head relative to the workpiece at a standoff distance based at least in part on the information indicative of the position of the cutting head relative to the workpiece obtained by the measurement device. A method of operating a waterjet cutting system is also provided.

51 Claims, 23 Drawing Sheets

(51) Int. Cl.

| | |
|---|---|
| ***B24C 9/00*** | (2006.01) |
| ***B24C 5/00*** | (2006.01) |
| ***B26F 3/00*** | (2006.01) |

(56) References Cited

U.S. PATENT DOCUMENTS

| | | | | |
|---|---|---|---|---|
| 3,894,180 | A * | 7/1975 | Canino | 369/233 |
| 3,996,825 | A * | 12/1976 | Terry | 83/53 |
| 4,435,902 | A * | 3/1984 | Mercer et al. | 30/296.1 |
| 4,802,156 | A * | 1/1989 | Shyu et al. | 369/132 |
| 4,814,574 | A * | 3/1989 | Babel et al. | 219/69.12 |
| 4,843,287 | A | 6/1989 | Taft | 318/568.16 |
| 4,878,676 | A * | 11/1989 | Johnson | 277/304 |
| 4,942,284 | A * | 7/1990 | Etcheparre et al. | 219/121.67 |
| 4,975,557 | A * | 12/1990 | Yamada et al. | 219/69.12 |
| 5,021,941 | A * | 6/1991 | Ford et al. | 700/71 |
| 5,387,969 | A * | 2/1995 | Marantette | 356/4.09 |
| 5,429,460 | A * | 7/1995 | Campian | 409/137 |
| 5,642,766 | A * | 7/1997 | MacCauley, III | 144/329 |
| 5,643,058 | A * | 7/1997 | Erichsen et al. | 451/99 |
| 5,877,960 | A | 3/1999 | Gross et al. | 364/474.17 |
| 5,887,122 | A * | 3/1999 | Terawaki et al. | 700/258 |
| 5,901,595 | A * | 5/1999 | Massee | 72/81 |
| 5,903,459 | A * | 5/1999 | Greenwood et al. | 700/110 |
| 6,001,219 | A * | 12/1999 | Caspar | 162/286 |
| 6,062,778 | A * | 5/2000 | Szuba et al. | 408/156 |
| 6,103,049 | A * | 8/2000 | Batdorf | 156/251 |
| 6,125,729 | A * | 10/2000 | Mirabello | 83/177 |
| 6,155,245 | A * | 12/2000 | Zanzuri | 125/12 |
| 6,172,374 | B1 | 1/2001 | Banks et al. | 250/559.3 |
| 6,204,475 | B1 * | 3/2001 | Nakata et al. | 219/121.84 |
| 6,280,302 | B1 | 8/2001 | Hashish et al. | 451/102 |
| 6,354,285 | B1 * | 3/2002 | Licht et al. | 125/13.01 |
| 6,379,214 | B1 | 4/2002 | Stewart et al. | 451/2 |
| 6,492,617 | B2 * | 12/2002 | Nagahori et al. | 219/121.84 |
| 6,540,586 | B2 * | 4/2003 | Sciulli | 451/2 |
| 6,649,123 | B2 * | 11/2003 | Babai | 266/76 |
| 6,766,216 | B2 * | 7/2004 | Erichsen et al. | 700/160 |
| 7,331,842 | B2 | 2/2008 | Sciulli et al. | 451/2 |
| 7,464,630 | B2 * | 12/2008 | Knaupp et al. | 83/177 |
| 7,578,210 | B2 | 8/2009 | Sciulli et al. | 73/866.5 |
| 7,591,615 | B2 * | 9/2009 | Li et al. | 408/67 |
| 7,615,128 | B2 * | 11/2009 | Mikkelsen | 156/88 |
| 7,635,289 | B2 | 12/2009 | Sciulli et al. | 451/2 |
| 7,703,363 | B2 | 4/2010 | Knaupp et al. | 83/177 |
| 7,803,036 | B2 * | 9/2010 | Sciulli et al. | 451/9 |
| 8,131,385 | B2 * | 3/2012 | Yuzawa | 700/56 |
| 8,527,084 | B2 * | 9/2013 | Maurer | 700/160 |
| 8,534,169 | B2 * | 9/2013 | Miyamoto et al. | 82/1.11 |
| 2001/0018855 | A1 | 9/2001 | Sciulli | |
| 2002/0036895 | A1 * | 3/2002 | Odashima et al. | 361/737 |
| 2003/0037650 | A1 | 2/2003 | Knaupp et al. | |
| 2003/0046801 | A1 * | 3/2003 | Engstrom et al. | 29/281.4 |
| 2004/0259478 | A1 | 12/2004 | Hashish et al. | |
| 2005/0051602 | A1 * | 3/2005 | Babb et al. | 228/112.1 |
| 2008/0216625 | A1 * | 9/2008 | Li et al. | 83/72 |
| 2009/0204272 | A1 * | 8/2009 | Yuzawa | 700/302 |
| 2009/0305611 | A1 | 12/2009 | Anton et al. | |
| 2010/0072261 | A1 * | 3/2010 | Cruz et al. | 228/102 |
| 2010/0173570 | A1 * | 7/2010 | Reukers | 451/91 |
| 2010/0294024 | A1 * | 11/2010 | Kumar et al. | 73/38 |
| 2011/0079339 | A1 * | 4/2011 | Cruz et al. | 156/64 |
| 2011/0087363 | A1 | 4/2011 | Petrescu et al. | 700/174 |
| 2011/0089956 | A1 * | 4/2011 | Hermann et al. | 324/686 |
| 2012/0111115 | A1 * | 5/2012 | Ume et al. | 73/588 |
| 2012/0111168 | A1 * | 5/2012 | Ota | 83/168 |
| 2012/0322347 | A1 * | 12/2012 | Molz et al. | 451/40 |
| 2013/0025422 | A1 * | 1/2013 | Chillman et al. | 83/53 |
| 2013/0112056 | A1 * | 5/2013 | Chacko et al. | 83/177 |
| 2013/0213200 | A1 * | 8/2013 | Cooper | 83/23 |

FOREIGN PATENT DOCUMENTS

| | | |
|---|---|---|
| JP | 2008-98216 | 4/2008 |
| JP | 2010-105113 | 5/2010 |

* cited by examiner

WATERJET CUTTING SYSTEM WITH STANDOFF DISTANCE CONTROL

BACKGROUND

1. Technical Field

This disclosure is related, generally, to waterjet cutting systems, and, in particular, to a method and apparatus for controlling a standoff distance between a waterjet cutting head and a surface of a workpiece to be processed.

2. Description of the Related Art

Fluid jet or abrasive-fluid jet cutting systems are used for cutting a wide variety of materials, including stone, glass, ceramics and metals. In a typical fluid jet cutting system, a high-pressure fluid (e.g., water) flows through a cutting head having a cutting nozzle that directs a cutting jet onto a workpiece. The system may draw an abrasive into the high-pressure fluid jet to form an abrasive-fluid jet. The cutting nozzle may then be controllably moved across the workpiece to cut the workpiece as desired. After the fluid jet, or abrasive-fluid jet, generically referred to throughout as a "waterjet," passes through the workpiece, the energy of the cutting jet is dissipated by a volume of water in a catcher tank. Systems for generating high-pressure waterjets are currently available, such as, for example, the Mach 4™ five-axis waterjet system manufactured by Flow International Corporation, the assignee of the present application. Other examples of waterjet cutting systems are shown and described in Flow's U.S. Pat. No. 5,643,058, which is incorporated herein by reference in its entirety.

Manipulating a waterjet in five or more axes may be useful for a variety of reasons, including, for example, cutting a three-dimensional shape. Such manipulation may also be desired to correct for cutting characteristics of the jet or for the characteristics of the cutting result. More particularly, as understood by one of ordinary skill in the relevant art, a cut produced by a waterjet has characteristics that differ from cuts produced by more traditional machining processes. These cut characteristics may include "taper" and "trailback," as explained in more detail in Flow's U.S. Pat. No. 7,331,842, which is incorporated herein by reference in its entirety. These cut characteristics, namely taper and trailback, may or may not be acceptable, given the desired end product. Taper and trailback vary, depending upon the thickness and hardness of the workpiece and the speed of the cut. Thus, one known way to control excessive taper and/or trailback is to slow down the cutting speed of the system. Alternatively, in situations where it is desirable to minimize or eliminate taper and trailback while operating at higher cutting speeds, five-axis systems may be used to apply taper and lead angle corrections to the waterjet as it moves along a cutting path. A method and system for automated control of waterjet orientation parameters to adjust or compensate for taper angle and lead angle corrections is described in Flow's U.S. Pat. No. 6,766,216, which is incorporated herein by reference in its entirety.

To maximize the efficiency and quality of the cutting process, a standoff distance between where the waterjet exits the nozzle and a surface of the workpiece is preferably controlled. If the standoff distance is too small, the nozzle can plug during piercing, causing system shutdown and possibly damage to the workpiece. If the distance is too great, the quality and accuracy of the cut suffers. Systems for detecting and controlling such a standoff distance are known, and include, for example, direct contact type sensing systems and non-contact inductance type sensing systems. Examples of waterjet cutting systems including a sensing system for controlling a standoff distance are shown and described in Flow's U.S. Pat. Nos. 7,331,842 and 7,464,630, which are incorporated herein by reference in their entireties.

Known standoff detection systems, however, typically require direct contact sensing of the workpiece surface from which the desired standoff distance is to be maintained or positioning of a non-contact inductance type sensor proximate the surface. These types of systems therefore often include features which may limit, for example, the mobility and/or flexibility of the waterjet cutting system to traverse a workpiece in a particularly advantageous cutting path. In addition, components of these systems may be unavoidably exposed to spray-back which occurs when the waterjet first impinges on a surface of a workpiece or as the waterjet interacts with a structure beneath the workpiece during operation, thereby leading to potential wear and damage of the components.

BRIEF SUMMARY

Embodiments described herein provide waterjet cutting systems and methods particularly well adapted for processing workpieces in a highly efficient and accurate manner by providing momentary, intermittent or continuous feedback of a waterjet nozzle standoff distance. Embodiments include a cutting head having an environment control device and a measurement device integrated therewith in a particularly compact form factor or package.

In one embodiment, a cutting head for a waterjet cutting system may be summarized as including a nozzle having an orifice through which fluid passes during operation to generate a high-pressure fluid jet for processing a workpiece and an environment control device. The environment control device may be positioned to act on a surface of the workpiece at least during a measurement operation and configured to establish a measurement area on the surface of the workpiece substantially unobstructed by fluid, vapor or particulate material. The measurement device may be positioned to selectively obtain information from within the measurement area indicative of a position of a tip of the nozzle of the cutting head relative to the workpiece. The obtained information may be used to optimize a standoff distance between the tip of the nozzle and the workpiece.

The cutting head may further include a wrist manipulable in space to position and orient the nozzle relative to the workpiece, and wherein the environment control device and the measurement device are positioned on the wrist to move in unison with the nozzle. An axis of the nozzle and a rotational axis of the wrist may define a reference plane, and the measurement device may be positioned to selectively obtain information in a location offset from the reference plane.

The measurement device may be configured to selectively generate a laser beam to impinge on the surface of the workpiece within the measurement area during the measurement operation. The environment control device may be configured to selectively generate an air stream, a centerline of the air stream oriented to intersect a path of the laser beam at a position below the surface of the workpiece. A centerline of the air stream may be oriented to impinge on the surface of the workpiece within the measurement area at a position aft of a path of the laser beam and to flow across the path of the laser beam during the measurement operation. The environment control device may be configured to selectively generate an air stream such that a centerline of the air stream and a path of the laser beam define an acute angle. The environment control device may be configured to selectively generate an air stream such that a centerline of the air stream is coaxially aligned with a path of the laser beam. The laser beam may be oriented parallel to a centerline of the nozzle or may be oriented at an acute angle with respect to the centerline of the nozzle.

In other embodiments, the measurement device may be a mechanical probe that is movable to probe the surface of the workpiece within the measurement area to obtain the information indicative of the position of the tip of the nozzle of the cutting head relative to the workpiece.

In other embodiments, the cutting head may include a probe movably coupled thereto which is positioned to contact the workpiece within the measurement area at least during the measurement operation, and the measurement device may be configured to selectively generate a laser beam to impinge on a surface of the probe to obtain information indicative of the position of the tip of the nozzle of the cutting head relative to the workpiece indirectly by measuring displacements of the probe relative to the cutting head as the cutting head moves relative to the workpiece.

The cutting head may further include a shield to protect portions of the cutting head and surrounding components during operation, the environment control device passing through a portion of the shield. The environment control device may be configured to generate a vacuum to establish the measurement area beneath the shield by evacuating vapor or other obstructions from a space generally enclosed by the shield and the surface of the workpiece. The environment control device may be configured to generate an air stream to establish the measurement area beneath the shield. The environment control device may be configured to concurrently generate a positive air stream and a vacuum to establish the measurement area. The measuring device may be configured to selectively generate a laser beam that passes through a void in the shield.

The cutting head may further include a shutter mechanism configured to selectively isolate an operative portion of the measurement device from a surrounding environment of the waterjet cutting system. The shutter mechanism may include a shutter movable between an open position and a closed position, the shutter isolating the operative portion of the measurement device from the surrounding environment when in the closed position and enabling the measurement device to obtain the information indicative of the position of the tip of the nozzle of the cutting head relative to the workpiece when in the open position. The shutter may be movably coupled to a linear actuator for selectively moving the shutter between the open position and the closed position. The shutter may be a deformable member coupled to a pressure generating source for selectively transitioning the shutter between the open position and the closed position. The shutter may be positioned in a housing to selectively isolate an internal cavity of the housing from the surrounding environment, and the housing may include a passageway to route pressurized air into the internal cavity. The passageway may be oriented to route pressurized air into the internal cavity of the housing across a face of an operable portion of the measurement device. The passageway may be connected to another passageway configured to feed pressurized air to the environment control device, and, when pressurized air is fed to the environment control device to generate an air stream, pressurized air may be simultaneously fed to the internal cavity of the housing. The shutter may be positioned in a housing to selectively isolate an internal cavity of the housing from the surrounding environment, and the shutter may be biased toward the housing.

According to another embodiment, a waterjet cutting system may be summarized as including a cutting head having a nozzle with an orifice through which fluid passes during operation to generate a high-pressure fluid jet for processing a workpiece; an environment control device positioned to act on a surface of the workpiece at least during a measurement operation, the environment control device configured to establish a measurement area on the surface of the workpiece substantially unobstructed by fluid, vapor or particulate material; a measurement device positioned to selectively obtain information from within the measurement area indicative of a position of a tip of the nozzle of the cutting head relative to the workpiece; and a control system to move the cutting head relative to the workpiece, the control system operable to position the tip of the nozzle of the cutting head relative to the workpiece at a standoff distance based at least in part on the information indicative of the position of the tip of the nozzle of the cutting head obtained from the measurement device.

The measurement device may be configured to selectively generate a laser beam to impinge on the surface of the workpiece, and the control system may be configured to filter out information obtained by the laser beam from target areas of the workpiece having pre-cut kerfs and to use information indicative of the tip of the nozzle of the cutting head relative to the workpiece only from uncut target areas of the workpiece when calculating the standoff distance. The measurement device may be configured to feed the information indicative of the tip of the nozzle of the cutting head relative to the workpiece to the control system to manipulate the nozzle of the cutting head during a cutting operation based at least in part on the information. The control system may also be configured to determine whether the laser beam is impinging on a surface beyond the workpiece by comparing a measurement reading of the laser beam with an expected measurement reading.

The waterjet cutting system may further include a wrist manipulable in space to position and orient the cutting head relative to the workpiece, and the environment control device and the measurement device may be positioned on the wrist to move in unison with the cutting head. The measurement device may be configured to selectively generate a laser beam to impinge on the measurement area during the measurement operation, and the environment control device may be configured to selectively generate an air stream, a centerline of the air stream oriented to impinge on the measurement area at a position aft of a path of the laser beam and to flow across the path of the laser beam during the measurement operation.

The waterjet cutting system may further include a shield to protect portions of the cutting head and surrounding components during operation, the environment control device passing through a portion of the shield. The environment control device may be configured to generate a vacuum to establish the measurement area beneath the shield by evacuating a space generally enclosed by the shield and the surface of the workpiece. The environment control device may be configured to generate an air stream to establish the measurement area beneath the shield.

The waterjet cutting system may further include a shutter mechanism configured to selectively isolate an operative portion of the measurement device from a surrounding environment of the waterjet cutting system.

According to another embodiment, a method of operating a waterjet cutting system having a cutting head may be summarized as including activating an environment control device of the cutting head to act on a surface of a workpiece to establish a measurement area on the surface of the workpiece substantially unobstructed by fluid, vapor or particulate material; and obtaining information from within the measurement area indicative of a position of the cutting head relative to the workpiece, such as, for example, a standoff distance of a nozzle of the cutting head from the workpiece.

The method may further include optimizing a standoff distance between a tip of a nozzle the cutting head and the workpiece. Optimizing the standoff distance between the tip of the nozzle of the cutting head and the workpiece may include obtaining the information from within the measurement area indicative of the position of the cutting head intermittingly during a cutting operation, and manipulating the cutting head based at least in part on the information. Optimizing the standoff distance between the tip of the nozzle of the cutting head and the workpiece may include obtaining the information from within the measurement area indicative of the position of the cutting head continuously during a cutting operation, and manipulating the cutting head based at least in part on the information. In some embodiments, a measurement operation may be executed prior to a cutting operation to establish a desired standoff distance that is maintained during the cutting operation. In some embodiments, a measurement operation may be executed while moving along a desired cutting path prior to a cutting operation to construct a workpiece profile. This workpiece profile can be generated, for example, by sensing the surface of the workpiece continuously or intermittingly during the measurement operation and storing surface data for subsequent cutting operations. Once obtained, the workpiece profile may be used to generate movements of the cutting head relative to the workpiece to maintain the tip of the nozzle at a constant standoff distance from the surface of the workpiece. In this manner, a desired path of the tip of the nozzle corresponding to a selected standoff distance from the workpiece may be "pre-mapped" prior to cutting. During such pre-mapping, measurements may be taken with or without the environment control device acting on the workpiece surface depending on, for example, the presence of water, vapor or other obstructions.

Obtaining information from within the measurement area indicative of the position of the cutting head relative to the workpiece may include utilizing a laser beam to sense a distance between a reference point and the surface of the workpiece. Activating the environment control device coupled to the cutting head to act on the surface of the workpiece may include generating an air stream to impinge on the surface of the workpiece. Activating the environment control device coupled to the cutting head to act on the surface of the workpiece may include creating a vacuum to evacuate a space overlying the surface of the workpiece.

The method of operating a waterjet cutting system having a cutting head may further include actuating a shutter mechanism to expose the measurement area to a measurement device coupled to the cutting head prior to obtaining information from within the measurement area indicative of the position of the cutting head relative to the workpiece. The method may further include pressurizing an internal cavity that is selectively isolated by the shutter mechanism from a surrounding environment. Actuating the shutter mechanism may include energizing an actuator to move a shutter of the shutter mechanism from a closed position to an open position. Actuating the shutter mechanism may include temporarily deforming a shutter of the shutter mechanism to transition the shutter from a closed position to an open position. The method may further include routing pressurized air across a face of an operable portion of a measurement device used to obtain the information from within the measurement area. The method may further include constructing a workpiece surface profile relative to the cutting head prior to a cutting operation based at least in part on information obtained via a laser beam impinging on the surface of the workpiece within the measurement area.

The method may further include detecting an edge of the workpiece by moving the cutting head across the edge and comparing positional information obtained from a laser beam impinging on the surface of the workpiece and positional information obtained from the laser beam impinging off of the surface of the workpiece. Thereafter, the edge of the workpiece may be aligned with a coordinate axis of a coordinate system of the waterjet cutting system.

According to another embodiment, a method of operating a waterjet cutting system having a cutting head may be summarized as including activating an environment control device of the cutting head to act on a surface of a workpiece support structure to establish a measurement area on the surface of the workpiece support structure substantially unobstructed by fluid, vapor or particulate material; and obtaining information from within the measurement area indicative of a position of the cutting head relative to the workpiece support structure. The method may further include leveling the workpiece support structure based at least in part on the information obtained from within the measurement area indicative of the position of the cutting head relative to the workpiece support structure.

DETAILED DESCRIPTION

Figure 1:
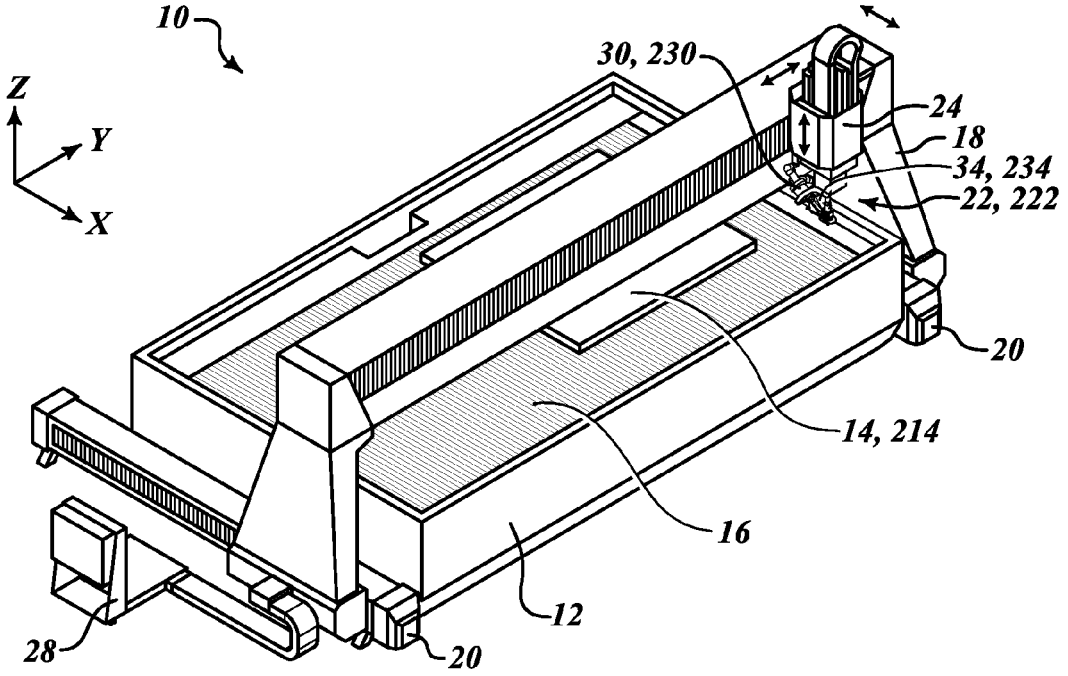
FIG. 1 is an isometric view of a waterjet cutting machine, according to one embodiment.

In the following description, certain specific details are set forth in order to provide a thorough understanding of various disclosed embodiments. However, one of ordinary skill in the relevant art will recognize that embodiments may be practiced without one or more of these specific details. In other instances, well-known structures associated with waterjet cutting systems and methods of operating the same may not be shown or described in detail to avoid unnecessarily obscuring descriptions of the embodiments. For instance, it will be appreciated by those of ordinary skill in the relevant art that a high-pressure fluid source and an abrasive source may be provided to feed high-pressure fluid and abrasives, respectively, to a cutting head of the waterjet systems described herein to facilitate, for example, high-pressure or ultrahigh-pressure abrasive waterjet cutting of workpieces. As another example, well know control systems and drive components may be integrated into the waterjet cutting system to facilitate movement of the cutting head relative to the workpiece to be processed. These systems may include drive components to manipulate the cutting head about multiple rotational and translational axes, such as, for example, as is common in five-axis abrasive waterjet cutting systems.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

Embodiments described herein provide waterjet cutting systems and methods particularly well adapted for processing workpieces in a highly efficient and accurate manner by providing momentary, intermittent or continuous feedback of a waterjet nozzle standoff distance. Embodiments include a cutting head having an environment control device and a measurement device arranged in a particularly compact form factor or package to enable highly accurate measurements to be taken prior to or during cutting operations to enable precise control of the standoff distance. As described herein, the term cutting head may refer generally to an assembly of components at a working end of the waterjet cutting machine, and may include, for example, a nozzle of the waterjet cutting system for generating a high-pressure waterjet and surrounding structures and devices coupled directly or indirectly thereto to move in unison therewith. The cutting head may also be referred to as an end effector.

FIG. 1 shows an example embodiment of a waterjet cutting system 10. The waterjet cutting system 10 includes a catcher tank 12 which is configured to support a workpiece 14 to be processed by the system 10. The catcher tank 12 includes a volume of water for absorbing energy of the cutting jet during cutting operations. In some instances, the volume of water will be set to a level just below the workpiece or at a level partially submerging or completely submerging the workpiece 14. Accordingly, the typical environment of the waterjet cutting system 10 is characterized by the presence of water, both in fluid and vapor form, as well as potentially other matter, such as, for example, particulate material including spent abrasives or pieces or remnants of processed workpieces.

The waterjet cutting system 10 further includes a bridge assembly 18 which is movable along a pair of base rails 20 and straddles the catcher tank 12. In operation, the bridge assembly 18 moves back and forth along the base rails 20 with respect to a translational axis X to position a cutting head 22 of the system 10 for processing the workpiece 14. A tool carriage 24 is movably coupled to the bridge assembly 18 to translate back and forth along another translational axis Y, which is aligned perpendicularly to the translational axis X. The tool carriage 24 is further configured to raise and lower the cutting head 22 along yet another translational axis Z to move the cutting head 22 toward and away from the workpiece 14. A manipulable forearm 30 and wrist 34 are provided intermediate the cutting head 22 and the tool carriage 24 to provide additional functionally.

Figure 2:
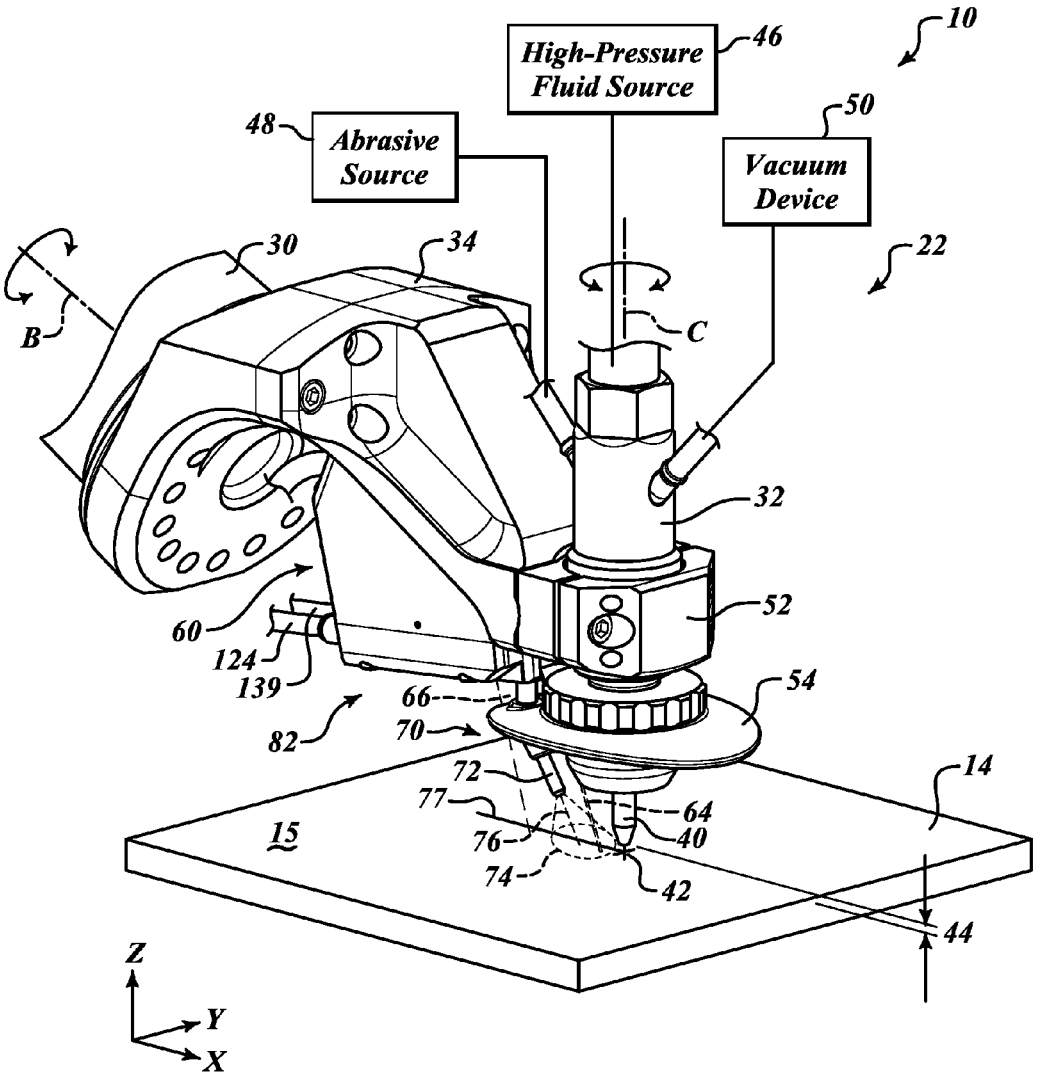
FIG. 2 is an isometric view of a cutting head, according to one embodiment, which is coupleable to a wrist of the waterjet cutting machine of FIG. 1 and shown overlying a workpiece.

More particularly, with reference to FIG. 2, the forearm 30 is rotatably coupled to the tool carriage 24 to rotate the cutting head 22 about an axis of rotation C coaxially aligned with a centerline of a body portion 32 of the cutting head 22. The wrist 34 is rotatably coupled to the forearm 30 to rotate the cutting head 22 about another axis of rotation B that is non-parallel to the aforementioned rotational axis C. In combination, the rotational axes B, C enable the cutting head 22 to be manipulated in a wide range of orientations relative to the workpiece 14 to facilitate, for example, cutting of complex profiles including three-dimensional shapes. The rotational axes B, C may converge at a focal point 42 which, in some embodiments, may be offset from the end or tip of a nozzle 40. The end or tip of the nozzle 40 of the cutting head 22 is preferably positioned to maintain a desired standoff distance 44 from the workpiece to be processed. The standoff distance 44 may be selected to optimize the cutting performance of the waterjet, and, in some embodiments, may range between about 0.010 inches and about 0.100 inches.

During operation, movement of the cutting head 22 with respect to each of the translational axes X, Y, Z and rotational axes B, C may be accomplished by various conventional drive components and an appropriate control system 28 (FIG. 1). Other well know systems associated with waterjet cutting machines may also be provided such as, for example, a high-pressure or ultrahigh-pressure fluid source 46 (e.g., direct drive and intensifier pumps with pressure ratings ranging from 40,000 psi to 100,000 psi. and higher) for supplying high-pressure or ultrahigh-pressure fluid to the cutting head 22 and/or an abrasive source 48 (e.g., abrasive hopper and distribution system) for feeding abrasives to the cutting head 22 to enable abrasive waterjet cutting. In some embodiments, a vacuum device 50 may be provided to assist in drawing abrasives into the fluid from the fluid source 46 to produce a consistent abrasive fluid jet to enable particularly accurate and efficient workpiece processing. Details of the control system 28, conventional drive components and other well known systems associated with waterjet cutting systems, however, are not shown or described in detail to avoid unnecessarily obscuring descriptions of the embodiments.

As shown in FIG. 2, the nozzle 40 may protrude from a working end of the cutting head 22. As is typical of conventional waterjet cutting systems, the nozzle 40 includes an orifice (not shown) through which fluid passes during operation to generate a fluid jet for processing the workpiece 14.

Figure 3:
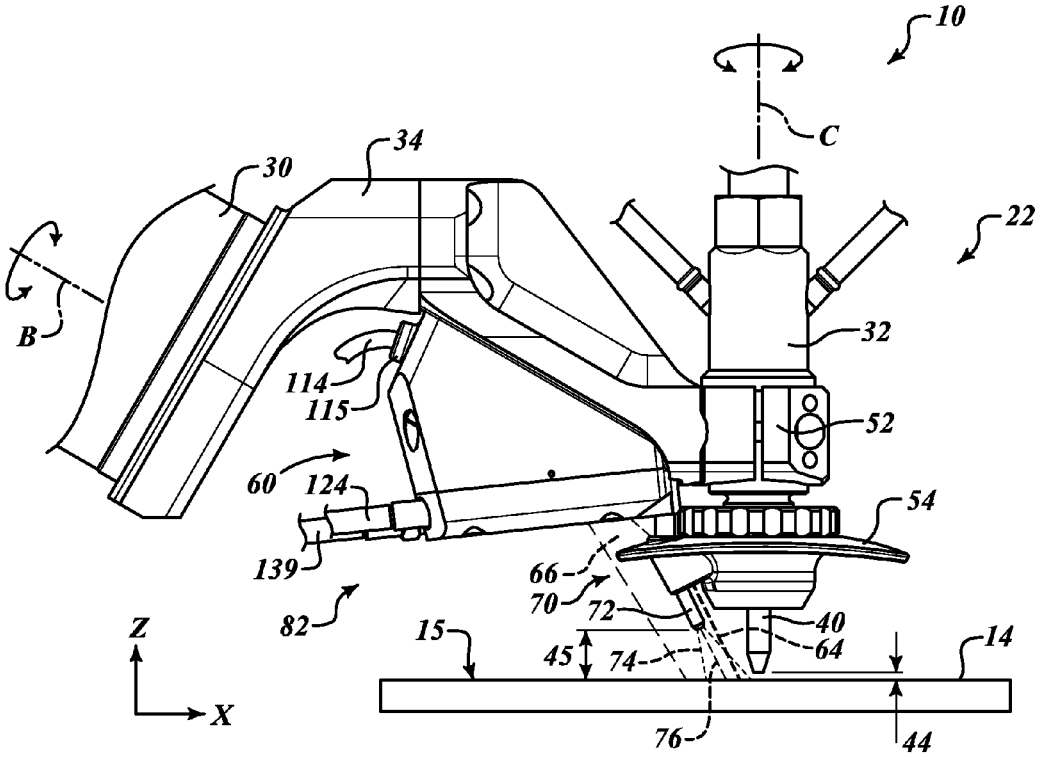
FIG. 3 is a side elevational view of the cutting head and workpiece of FIG. 2.

With reference to FIGS. 2 and 3, the cutting head 22 may be removably coupled to the wrist 34 by a clamp structure 52 or other fastening mechanism to facilitate assembly and disassembly of the cutting head 22. A shield 54 may be provided at a lower end of the cutting head 22 to protect portions of the cutting head 22 and other components of the waterjet cutting system 10 from spray-back during operation. In some embodiments, the shield 54 may fan out from the cutting head 22 in an umbrella-like fashion over the nozzle 40.

The cutting head 22 further includes a measurement device 60 for obtaining information indicative of a distance between a tip of the nozzle 40 of the cutting head 22 and the workpiece 14 to control the standoff distance 44. Information indicative of a distance between a tip of the nozzle 40 of the cutting head 22 and the workpiece 14 can include direct or indirect measurements of the location of the tip of the nozzle 40 with respect to the workpiece 14, such as, for example, the distance between a surface 15 of the workpiece 14 and the measurement device 60 or any other reference point or surface on the cutting head 22 having a known relationship to the tip of the nozzle 40.

The measurement device 60 of the illustrated embodiment is a laser displacement sensor 62 (FIGS. 5 through 7), such as, for example, a CD33 Series CMOS laser displacement sensor available from Optex FA Co., Ltd. The laser displacement sensor 62 is configured to selectively generate a laser beam 64 to impinge on the workpiece surface 15 to obtain information indicative of the distance between the sensor 62 and the workpiece surface 15 and to detect changes in said distance. With this information, the standoff distance 44 can be calculated and controlled to a high degree of precision. For example, a measured distance may be compared with an expected distance corresponding to the desired standoff 44 and corresponding adjustments to the cutting head 22 can be made based on the result. In some embodiments, measurements may be taken intermittingly while cutting a workpiece 14 or may be taken continuously while cutting a workpiece 14. In some embodiments, measurements may be taken during a measurement operation prior to a cutting operation and repeated periodically as needed to ensure a desired level of accuracy of the standoff distance 44 during operation of the waterjet cutting system 10. Advantageously, in some embodiments, the control system 28 (FIG. 1) may be configured to initiate measurement operations only at times when the cutting head 22 is not piercing through the workpiece 14, as splash-back is more prevalent at these times and may cause excessive wear or damage to components of the cutting head 22, including the measurement device 60.

In some embodiments, and with reference to FIGS. 2 and 3, the sensor 62 is positioned such that the laser beam 64 impinges on the workpiece surface 15 near the nozzle 40, such as, for example, within a radius of 4 inches, 3 inches, 2 inches or less from where the axis of rotation C intersects the workpiece surface 15. In such embodiments, the obtained data may more accurately reflect a standoff distance 44 of the nozzle 40 of the cutting head 22 from the workpiece surface 15, as compared to embodiments in which measurements are taken relatively more remotely from the nozzle 40.

Characteristics of the laser beam 64 may be analyzed by the sensor 62 to determine the distance between the sensor 62 and the workpiece surface 15 and to detect changes in said distance. For this purpose, the sensor 62 includes a detection window having a field of view 66 with which to collect data related to the impingement of the laser beam 64 on the workpiece surface 15. While the presently described sensor 62 provides particularly advantageous functionality, it is appreciated that other distance sensors and sensing technology may be used in lieu of the laser displacement sensor 62 described above.

For example, a laser auto focus device, such as, for example, the laser auto focus system available from Motion X Corporation under the trademark FocusTrac™, may be integrated into the cutting head 22 and used to gather or obtain information indicative of the distance between the cutting head 22 and the workpiece 14. This auto focus device can differentiate between "in-focus," "above focus" and "below focus" conditions to produce a relative error signal that can be used to determine the distance between the cutting head 22 and the workpiece 14 and make adjustments to the position of the cutting head 22 to optimize the standoff distance 44. As another example, a dual laser system including two distinguishable laser beams may be provided wherein the laser beams are oriented to converge at a point when the desired standoff distance is achieved, and conversely, appear as separate features on the workpiece surface 15 when the cutting head 22 is too close or too far way. An imaging device may be used to monitor the points at which the laser beams impinge on the work surface and produce a signal that may be used to move the cutting head 22 until the laser beams converge. The aforementioned examples are not intended to be limiting. The sensor 62 may include a wide range of optical sensors, laser sensors, distance sensors, image sensors or other distance sensing technology.

Irrespective of the type of sensor 62 or sensing technology utilized, embodiments of the cutting head 22 and waterjet cutting system 10 advantageously include an environment control device 70 to condition an area on the workpiece surface 15 for accurate detection and control of the standoff distance 44. More particularly, the environment control device 70 is positioned to act on the workpiece surface 15 and establish a measurement area that is substantially unobstructed by elements of the surrounding environment, including, for example, fluid, vapor, and particulate material, such as spent abrasives. Substantially unobstructed means at least that a majority of the measurement area is uncovered by water or other obstructions and that a path from the measurement device 60 to the measurement area is essentially free of obstructions that would otherwise significantly hinder readings of the sensor 62.

With continued reference to FIGS. 2 and 3, the environment control device 70 of the example embodiment includes an air nozzle 72 for the purpose of clearing the measurement area of fluid and potentially other obstructions that may be generated in the environment, such as, for example, particulate material or vapor generated during a cutting operation. The air nozzle 72 is positioned to generate an air stream 74 that impinges on the workpiece surface 15 aft of a path of the laser beam 64 of the measurement device 60 and flows across the path of the laser beam 64 during a measurement operation (i.e., while the measurement device 60 is obtaining the information indicative of the distance between the sensor 62 and the workpiece surface 15). In some embodiments, a centerline 76 of the air stream 74 and a path of the laser beam 64 selectively emitted from the sensor 62 may define an acute angle, such as, for example, 20°, 30° or 40°. In other embodiments, the centerline 76 of the air stream 74 and a path of the laser beam 64 may be parallel or collinear. The pressure and volumetric flow rate of the air stream 74 may be selected such that the air stream 74 effectively clears the measurement area of any fluid or other obstructions of the surrounding environment. In some embodiments, the air stream 74 may be selected, for example, to operate during a measurement operation at a flow rate of about 10 to 50 cubic feet per hour through the air nozzle 72 while maintained at a pressure of about 20 psi to about 70 psi. In some embodiments, the air stream 74 has sufficient kinetic energy to clear a measurement area on the workpiece surface 15 even while the workpiece surface 15 is otherwise slightly submerged below the surface of a water level maintained in the catcher tank 12 (FIG. 1) supporting the workpiece 14. In some embodiments, the air stream 74 has sufficient kinetic energy to clear a measurement area on the workpiece surface 15 up to about four square inches or more.

Further details of the cutting head 22, including the measurement device 60 and environment control device 70, are described with reference to FIGS. 4 through 11.

Figure 4:
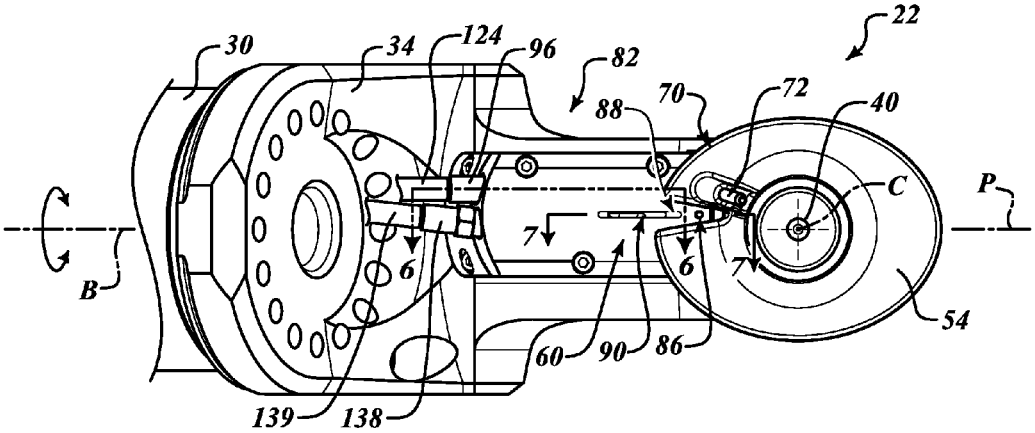
FIG. 4 is a bottom plan view of the cutting head of FIG. 2.

FIG. 4 shows the underside of the cutting head 22 and illustrates, among other things, the positional arrangement of the nozzle 40 with respect to the measurement device 60 and the environment control device 70. As can be appreciated from FIG. 4, the rotational axis B and a centerline of the nozzle 40 of the cutting head 22 define a central reference plane P which essentially bisects the cutting head 22 into opposing halves. The measurement device 60 is positioned such that an operative or sensing portion of the measurement device 60 is offset from this central reference plane P. In this manner, when the cutting head 22 is oriented to align with one of the primary translational axes X, Y of the waterjet cutting system 10 and instructed to cut in the same direction, the sensor 62 is able to obtain positional information without interference from a kerf 77 (FIG. 2) of a cutting operation. In other embodiments, the measurement device 60 may be aligned to act in line with the central reference plane P and the cutting head 22 can be manipulated to avoid positioning a target area of the measurement device over a kerf 77 of a cutting operation.

As further shown in FIG. 4, the air nozzle 72 of the environment control device 70 may be mounted to or integrally received in the shield 54 of the cutting head 22. In this manner, the air nozzle 72 may be positioned near the nozzle 40 of the cutting head 22 in a particularly compact form factor. In this configuration, the air nozzle 72 may interfere less with an ability to manipulate the cutting head 22 around workpieces having, for example, three-dimensional shapes and complex contours. In addition, the air stream 74 may be generated with relatively less energy compared to other embodiments as a result of the proximity of the air nozzle 72 to the workpiece surface 15. Still further, the proximity of the unobstructed measurement area relative to the nozzle 40 of the cutting head 22 may increase the relative accuracy with which the standoff distance 44 may be controlled as compared to embodiments in which the air nozzle 72 is more remotely located. In some embodiments, the outlet of the air nozzle 72 may be positioned to lie within a six inch hemisphere having its center at the focal point 42 of the waterjet cutting system 10.

Figure 5:
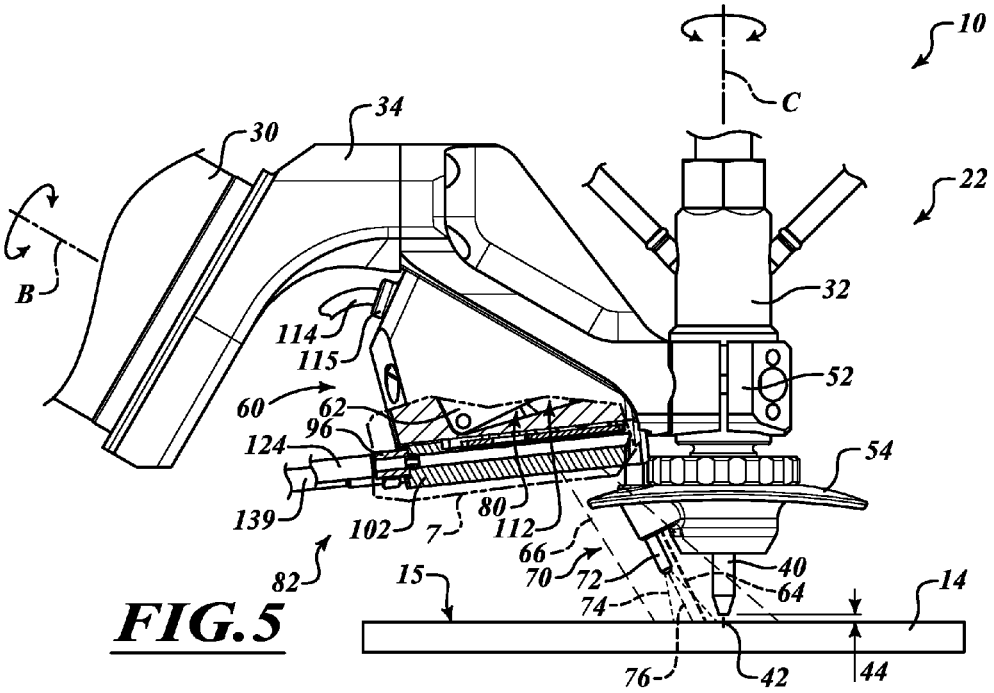
FIG. 5 is a partially broken side elevational view of the cutting head and workpiece of FIG. 2.
Figure 6:
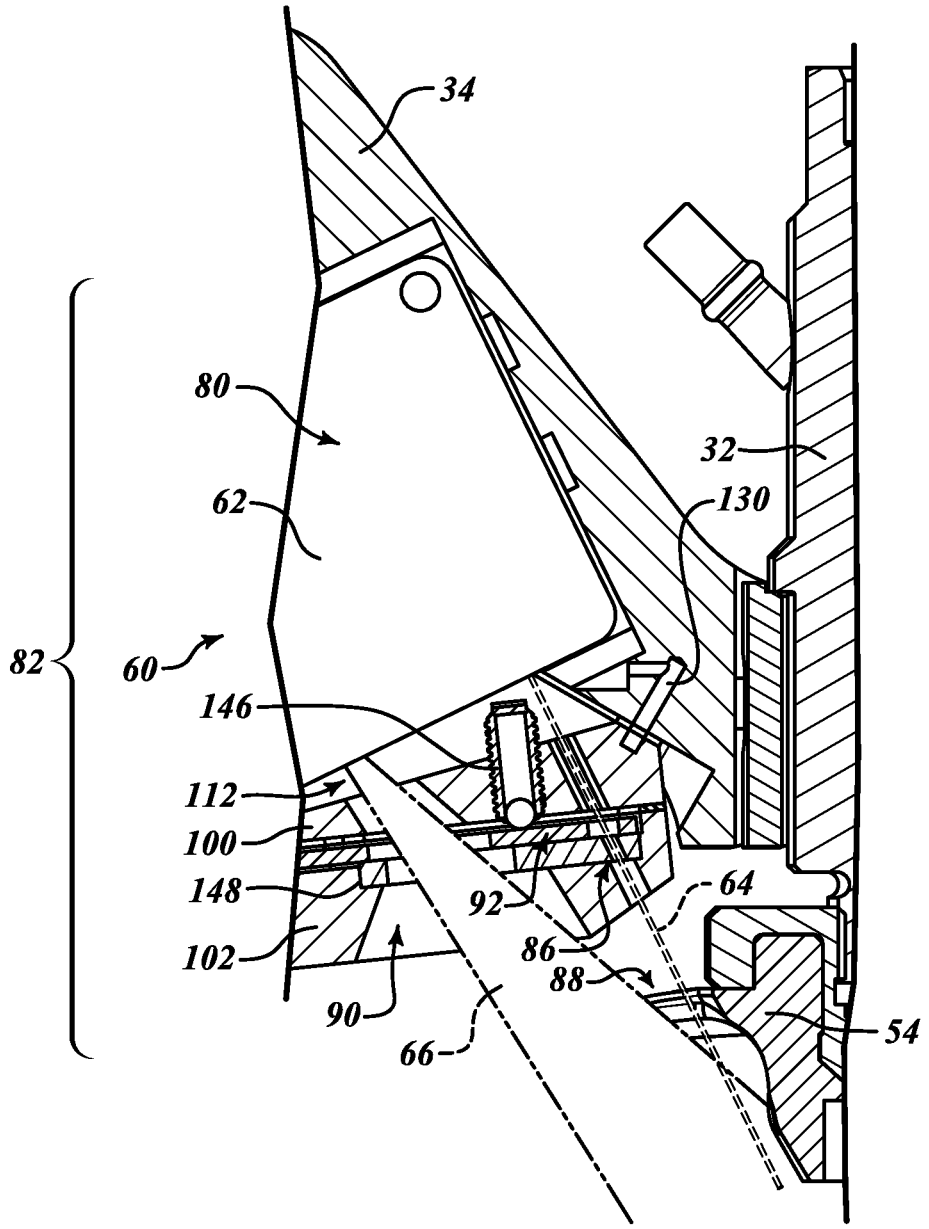
FIG. 6 is an enlarged detail view of a portion of the cutting head of FIG. 2 taken along line 6-6 of FIG. 4.
Figure 7:
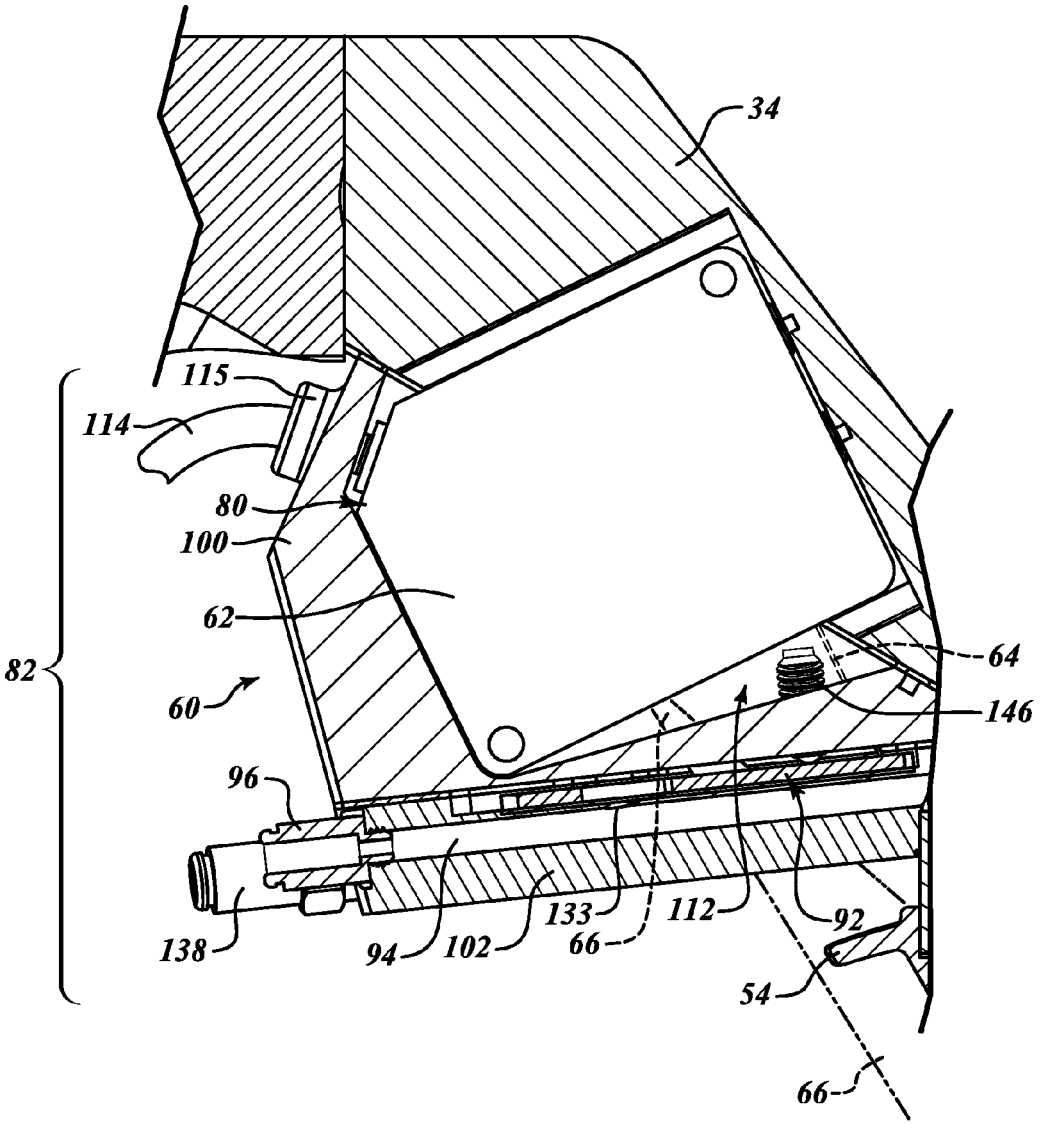
FIG. 7 is an enlarged detail view of a portion of the cutting head of FIG. 2 taken along line 7-7 of FIG. 4.

FIGS. 5 through 7 illustrate additional features of the measurement device 60 and environment control device 70. For example, the laser displacement sensor 62 of the measurement device 60 is shown received in an internal cavity 80 of a housing assembly 82 secured to the wrist 34 of the waterjet cutting system 10. The housing assembly 82 may support the sensor 62 in a desired orientation to direct the laser beam 64 selectively emitted therefrom toward the measurement area. In the example embodiment, the sensor 62 is oriented in an inclined orientation with respect to a plane perpendicular to the rotational axis C and positioned such that the laser beam 64 passes through a passageway 86 in the housing assembly 82 and subsequently a void 88 in the shield 54, as best shown in FIG. 6, to ultimately impinge on the workpiece surface 15 relatively close to the nozzle 40 of the cutting head 22. As shown in FIG. 6, another passageway 90 is provided in the housing assembly 82 for enabling the detection window of the sensor 62 having a field of view 66 to selectively detect or obtain information related to the impingement of the laser beam 64 on the workpiece surface 15.

With reference to FIG. 7, the measurement device 60 may further include a shutter mechanism 92 to selectively isolate the operative or sensing portion of the laser displacement sensor 62 from the external environment of the waterjet cutting system 10. The shutter mechanism 92 may be received within the housing assembly 82 to operate intermediately between the sensor 62 and the workpiece surface 15. As shown best in FIG. 7, the housing assembly 82 may include a passageway 94 to route air to the air nozzle 72 of the environment control device 70. Conventional fittings 96, adapters and/or couplings may be provided in communication with the passageway 94 to facilitate the connection of a pressurized air source to the passageway 94 to selectively feed air to the air nozzle 72. The passageway 94 may lead completely through the housing assembly 82 and to a corresponding passageway in the shield 54. To facilitate routing pressurized air through the shield 54, the housing assembly 82 may include an extension 97 having a central passageway 98 for interfacing with the shield 54, as shown best in FIGS. 8 and 9. Pressurized air is fed from the housing assembly 82, through the shield 54, and ultimately out of the air nozzle 72 of the cutting head 22 and onto the workpiece surface 15.

Further details of the housing assembly 82 and shutter mechanism 92 are described with reference to FIGS. 8 through 11.

Figure 8:
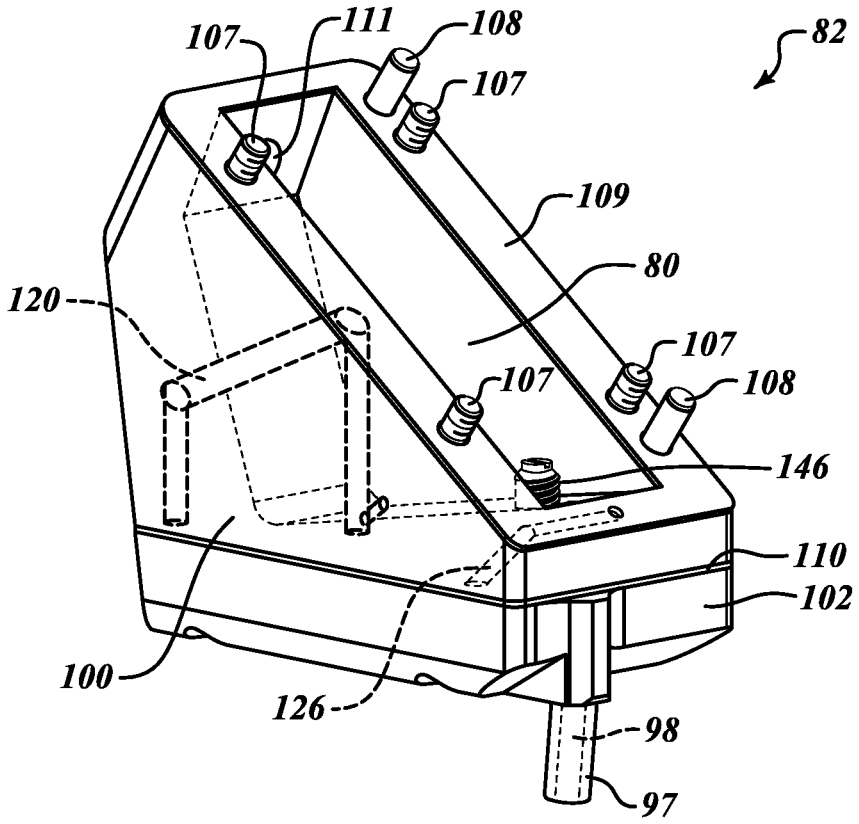
FIG. 8 is an isometric view of a housing assembly of the cutting head of FIG. 2.
Figure 9:
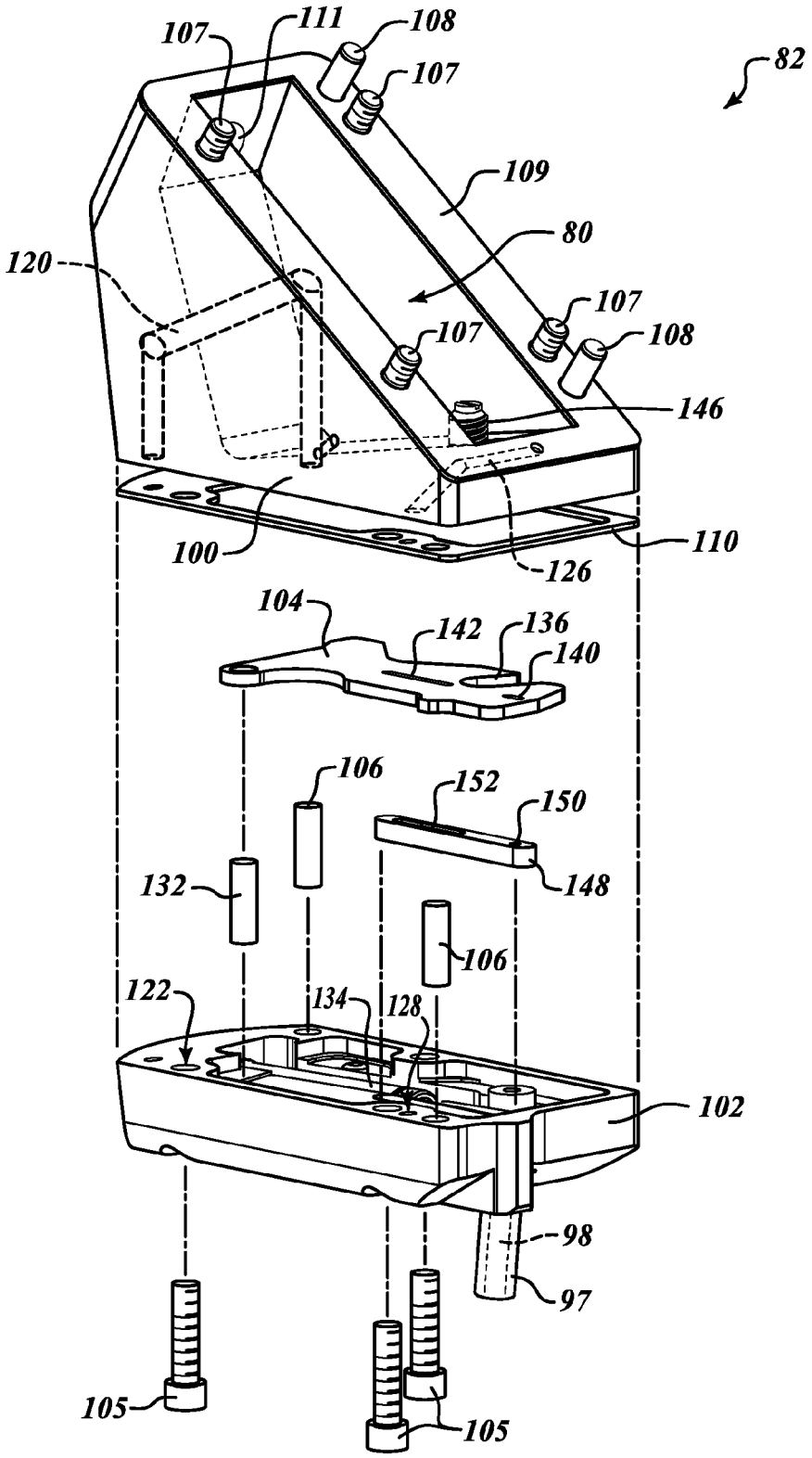
FIG. 9 is an isometric exploded view of the housing assembly of FIG. 8.

FIG. 8 shows the housing assembly 82 in an assembled configuration and FIG. 9 shows the housing assembly 82 in an exploded view. The housing assembly 82 includes an upper housing 100 that is removably coupleable to a lower housing 102 to receive therebetween a shutter 104 of the shutter mechanism 92. The upper housing 100 and the lower housing 102 may be secured together via conventional fastening devices such as, for example, threaded bolts 105 passing through the lower housing 102 and engaging threaded holes in the upper housing 100. Alignment pins 106, 108 or other guides may be provided to maintain an accurate spatial relationship between the components as they are joined together. In a similar fashion, the upper housing 100 may be secured to the wrist 34 of the cutting head system 10 by conventional fastening devices such as, for example, threaded bolts 107 passing through the upper housing 100 and engaging threaded holes in the wrist 34. Alignment pins 106, 108 or other guides may be provided to maintain an accurate spatial relationship between the components as they are joined together. One or more gaskets 109, 110 may be provided to seal mating components of the housing assembly 82 together and to the wrist 34 of the cutting head system 10. In this manner, a substantially sealed internal chamber 112 (FIGS. 5 through 7) may be established within the housing assembly 82 in front of at least the operational or sensing portions of the sensor 62. This chamber 112 can be pressurized during operation as discussed in more detail below to assist in maintaining a particularly sterile environment around at least the operable or sensing portions of the sensor 62.

As previously discussed, the housing assembly 82 includes a cavity 80 to accommodate the sensor 62. Additionally, an aperture 111 may be provided in the housing assembly 82 for routing an electrical cable 114 (FIG. 7) of the sensor 62 external to the housing assembly 82. The cable 114 is electrically coupled to the control system 28 (FIG. 1) such that the control system 28 may receive signals indicative of the information collected during a measurement operation and adapt the position, orientation and/or trajectory of the cutting head 22 in response to the same in order to maintain a desired standoff distance 44. A grommet, bushing and/or strain relief 115 (FIG. 7) may be provided in combination with the aperture 111 to guide the cable 114 from the housing assembly 82 and maintain a substantially sealed environment within the housing assembly 82.

As shown in FIGS. 8 and 9, a passageway 120, may be formed in a section of the upper housing 100 via cross drilling or other known manufacturing and machining techniques. The passageway 120 may align with a corresponding passageway 122 in the lower housing 102 which is ultimately connected to a pressured air source via a feed conduit 124 (FIGS. 1 through 5). The passageway 120 may be routed such that, during a measurement procedure, the passageway 120 directs an air stream across an operable or sensing portion of the sensor 62, such as, for example, a detection window of the sensor 62. Another passageway 126 may be formed in another section of the upper housing 102 via cross drilling or other known manufacturing and machining techniques. This passageway 126 may be aligned with a corresponding passageway 128 in the lower housing 102 which is ultimately connected to the pressured air source via the feed conduit 124 (FIGS. 1 through 5). In addition, the passageway may be aligned with a corresponding passageway 130 (FIG. 6) in the wrist 34 which is positioned to route an air stream across another operable or sensing portion of the sensor 62 during operation, such as, for example, a laser beam generating portion of the sensor 62. In this manner, pressurized air may be introduced into the chamber 112 to pressurize the same and may flow across operable or sensing portions of the sensor 62 when the shutter mechanism 92 is energized and the shutter 104 actuated to expose the operable or sensing portions of the sensor 62 to the environment. In addition, one or more additional passageways 133 (FIGS. 10 and 11) may be provided in the lower housing 102 in combination with or in lieu of the other passageways 120, 122, 126, 128, 130 to feed pressurized air to the internal chamber 112. The noted passageways advantageously allow the system 10 to maintain positive pressure in the internal chamber 112 to assist in maintaining a particularly sterile environment, and also provide a mechanism for clearing any debris, vapor or other potential obstructions from the path or paths of the operable or sensing portions of the sensor 62. Accordingly, sensor readings may be acquired in a particularly accurate manner.

Figure 10:
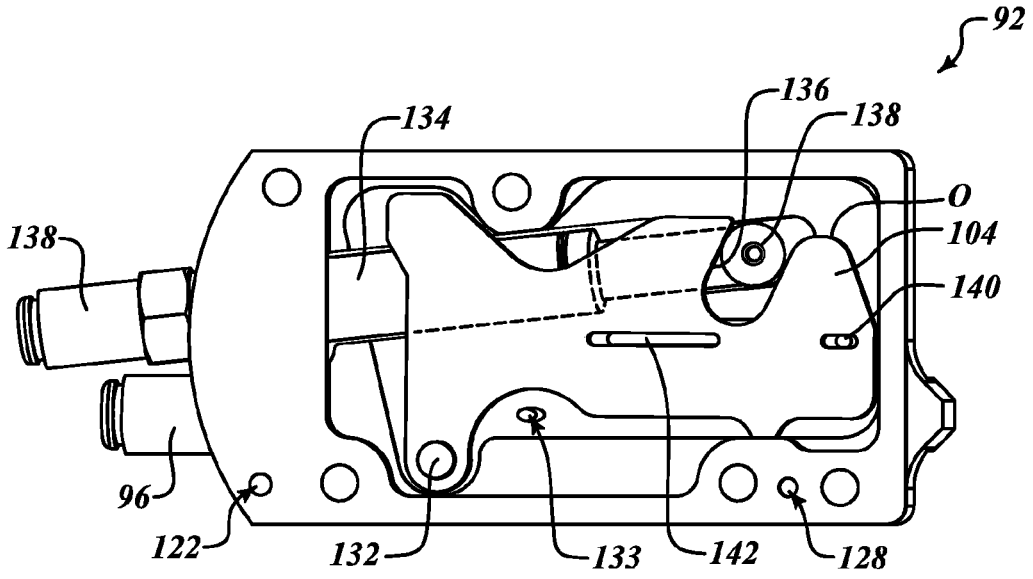
FIG. 10 is a top plan view of a portion of the housing assembly of FIG. 8 with a shutter thereof shown in an open position.
Figure 11:
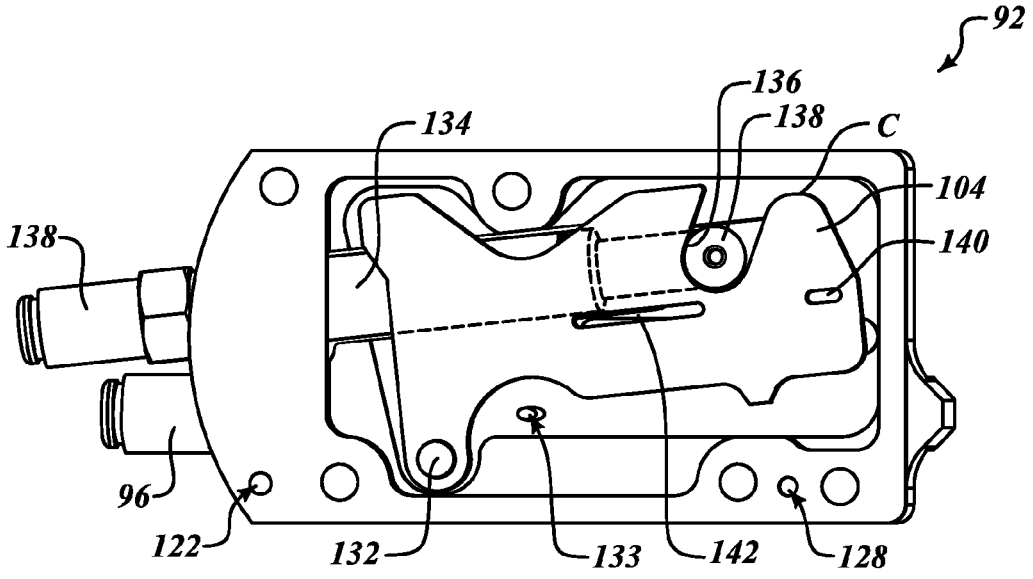
FIG. 11 is a top plan view of a portion of the housing assembly of FIG. 8 with a shutter thereof shown in a closed position.

According to the example embodiment of the shutter mechanism 92 shown best in FIGS. 9 through 11, the shutter mechanism 92 includes a shutter 104 pivotably mounted between the upper housing 100 and the lower housing 102 via a pivot 132. An actuator 134, which may be in the form of a linear gas cylinder, for example, is operatively coupled to the shutter 104 to transition the shutter 104 between an open position O, as shown in FIG. 10, and a closed position C, as shown in FIG. 11. The shutter 104 may include a cam feature 136 for interoperating with a displaceable end 137 of the actuator 134 for this purpose. Fittings 138, adapters and/or couplings may be provided in communication with the actuator 134 to facilitate the connection of a pressurized air source to selectively feed air to the actuator 134. Air may be provided to the actuator 134, for example, by a feed conduit 139 (FIGS. 1 through 5).

The shutter 104 further includes one or more windows 140, 142 for enabling the operable or sensing portions of the sensor 62 to obtain readings through the shutter 104 when in the open position O. In the closed position C, the shutter 104 is configured to close off or substantially block the passageways 86, 90 and effectively seal the interior chamber 112 of the housing assembly 82 from the environment of the waterjet cutting system 10. To assist in sealing off the chamber 112, the shutter 104 may be biased toward the lower housing 102, such as, for example, by a biasing mechanism 146 (FIGS. 6 through 9) coupled to the housing assembly 82. In one embodiment, the biasing mechanism 146 may be a spring-biased plunger mechanism installed in the upper housing 100 which is configured to urge the shutter 104 toward the lower housing 102 to effectively seal the internal chamber 112. A bearing 148 may be provided on which the shutter 104 rides. The bearing 148 may include apertures 150, 152 corresponding sized and spaced to correspond to the windows 140, 142 of the shutter 104 when in the open position O. The shutter 104 may be urged into sealing contact with the bearing 148 (FIG. 9) or may be urged directly against the lower housing 102. Accordingly, the shutter mechanism 92 provides one example of a configuration sufficient to selectively isolate the operative or sensing portions of the sensor 62 during times when the sensor 62 might otherwise be subjected to harsh conditions, such as during initial piercing of a workpiece 14 with a waterjet.

FIGS. 12 through 22 illustrate another example embodiment of a cutting head 222 for use in a waterjet cutting system, such as the waterjet cutting system 10 shown and described with reference to FIG. 1.

Figure 12:
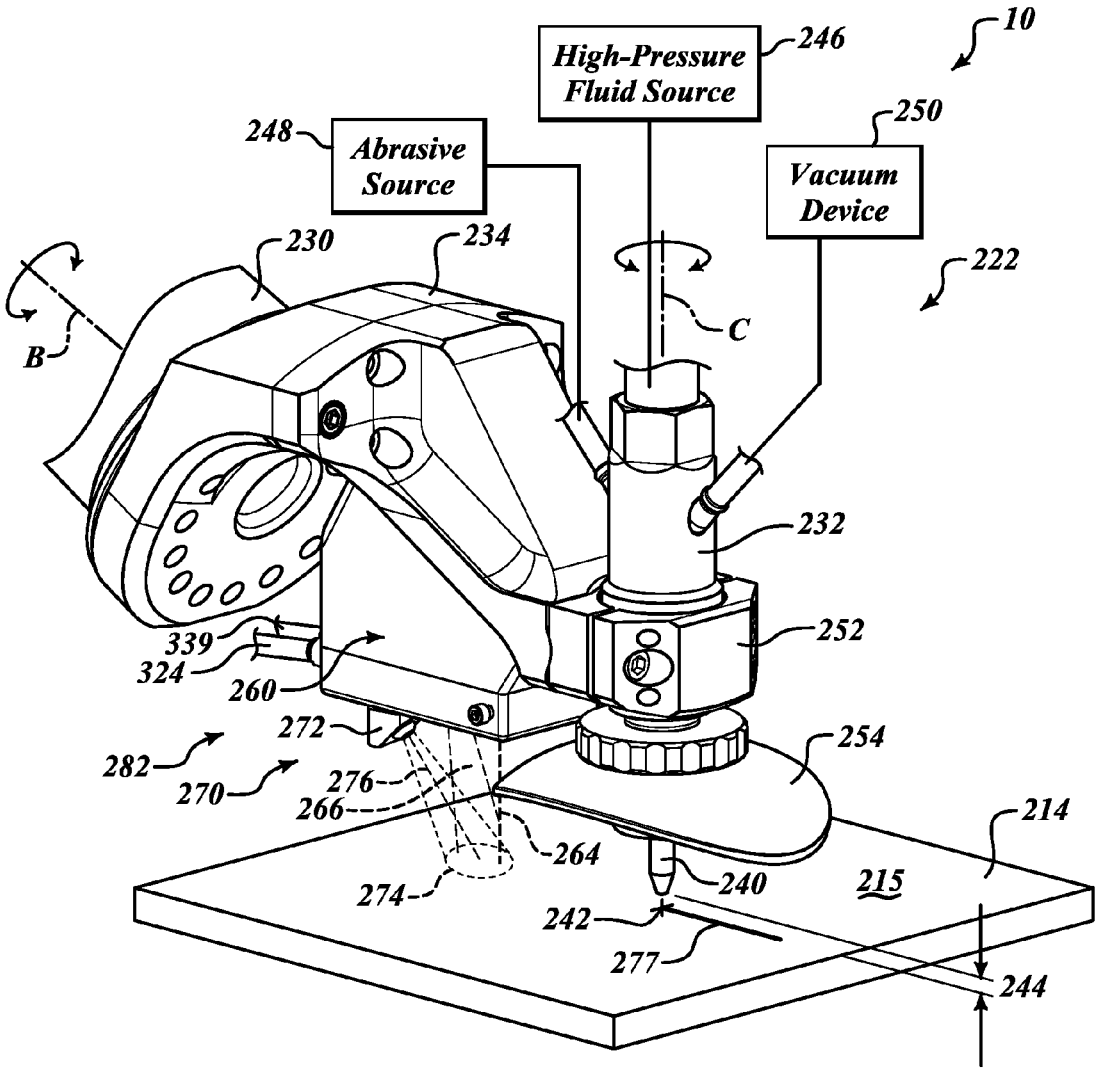
FIG. 12 is an isometric view of a cutting head, according to another embodiment, which is coupleable to a wrist of the waterjet cutting machine of FIG. 1 and shown overlying a workpiece.
Figure 13:
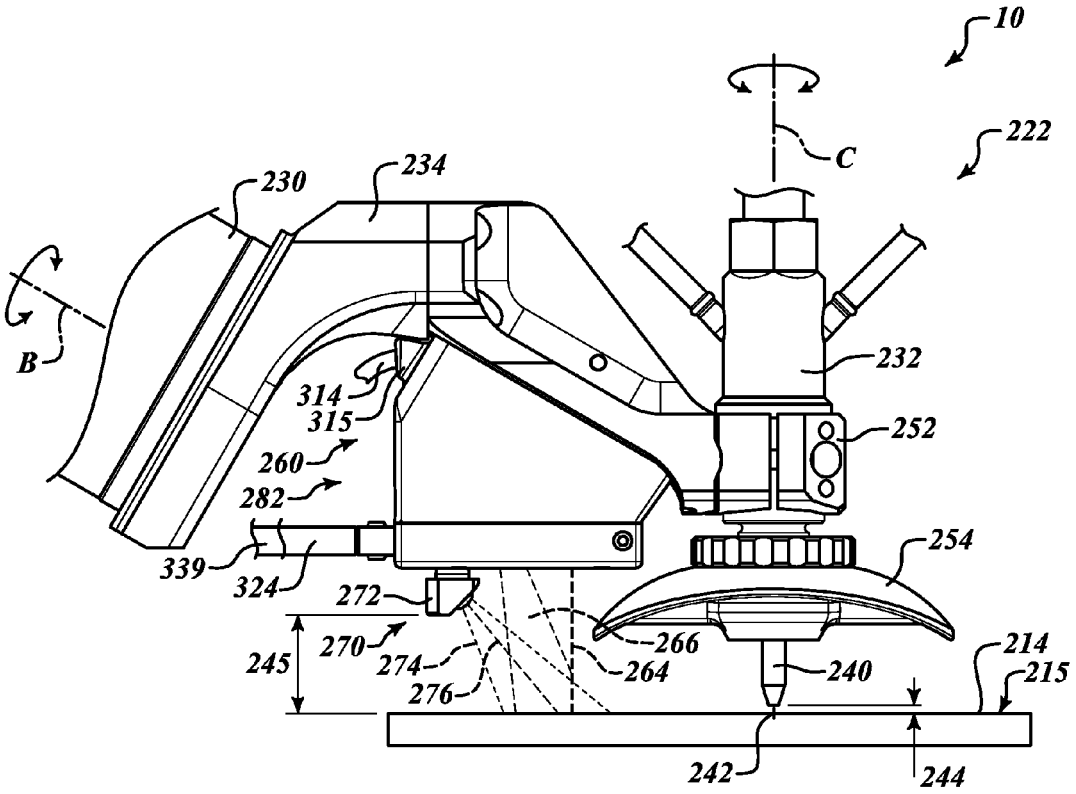
FIG. 13 is a side elevational view of the cutting head and workpiece of FIG. 12.

With reference to FIGS. 12 and 13, and similar to the previously described embodiment, the cutting head 222 may be removably coupled to a wrist 234 of the waterjet cutting system 10 by a clamp structure 252 or other fastening mechanism to facilitate assembly and disassembly of the cutting head 222. A shield 254 may be provided at a lower end of the cutting head 222 to protect portions of the cutting head 222 and other components of the waterjet cutting system 10 from spray-back during operation. In some embodiments, the shield 254 may fan out from the cutting head 222 in an umbrella-like fashion over a nozzle 240 thereof.

The cutting head 222 further includes a measurement device 260 for detecting the distance between the cutting head 222 and a workpiece 214 to control a standoff distance 244 of the nozzle 240 of the cutting head 222 from the workpiece 214. In the example embodiment shown in FIGS. 12 and 13, the measurement device 260 includes a laser displacement sensor 262 (FIGS. 15 through 18), such as, for example, a CD33 Series CMOS laser displacement sensor available from Optex FA Co., Ltd. The laser displacement sensor 262 is configured to selectively generate a laser beam 264 to impinge on a workpiece surface 215 of the workpiece 214 to obtain information indicative of the distance between the sensor 262 and the workpiece surface 215 and to detect changes in said distance. With this information, the standoff distance 244 can be calculated and controlled to a high degree of precision. For example, a measured distance may be compared with an expected distance corresponding to the desired standoff 244 and corresponding adjustments to the cutting head 222 can be made based on the result. Again, in some embodiments, measurements may be taken intermittingly while cutting a workpiece 214 or may be taken continuously while cutting a workpiece 214. In some embodiments, measurements may be taken prior to a cutting operation and repeated periodically as needed to ensure a desired level of accuracy during operation of the waterjet cutting system 10. Advantageously, in some embodiments, the control system 28 (FIG. 1) may be configured to initiate measurement operations only at times when the cutting head 222 is not piercing through the workpiece 14, as splash-back is more prevalent at these times and may cause excessive wear or damage to components of the cutting head 222, including the measurement device 260.

In some embodiments, the laser beam 264 is oriented to impinge on the workpiece surface 215 beyond a perimeter of the shield 254 and relatively remote from the nozzle 240, such as, for example, beyond a radius of about six inches or more from where the axis of rotation C intersects the workpiece surface 215. In such embodiments, the obtained data may be detected further from the operational end of the nozzle 240 at a position less influenced by cutting operations. Characteristics of the laser beam 264 may be analyzed by the sensor 262 to determine the distance between the sensor 262 and the workpiece surface 215 and to detect changes in said distance. For this purpose, the sensor 262 includes a field of view 266 with which to collect data related to the impingement of the laser beam 264 on the workpiece surface 215. Again, while the presently described laser displacement sensor 262 provides particularly advantageous functionality, it is appreciated that other distance sensors and sensing technology may be used in lieu of the laser displacement sensor 262.

Irrespective of the type of sensor 262 or sensing technology utilized, embodiments of the cutting head 222 advantageously include an environment control device 270 to condition an area on the workpiece surface 215 for accurate detection and control of the standoff distance 244. More particularly, the environment control device 270 is positioned to act on the workpiece surface 215 and establish a measurement area that is substantially unobstructed by elements of the surrounding environment, including, for example, fluid, vapor and particulate material, such as spent abrasives.

According to the example embodiment shown in FIGS. 12 and 13, the environment control device 270 includes an air nozzle 272 for the purpose of clearing the measurement area of obstructions that may be generated in the surrounding environment, such as, for example, fluid, vapor and particulate material generated during a cutting operation. The air nozzle 272 is configured to generate an air stream 274 that impinges on the workpiece surface 215 aft of a path of the laser beam 264 of the measurement device 260 and flows across the path of the laser beam 264 during a measurement operation (i.e., while the measurement device 260 is obtaining the information indicative of the distance between the sensor 262 and the workpiece surface 215). In some embodiments, a centerline 276 of the air stream 274 and a path of the laser beam 264 selectively emitted from the sensor 262 may define an acute angle, such as, for example, 20°, 30° or 40°. In other embodiments, the centerline 276 of the air stream 274 and a path of the laser beam 264 may be parallel or collinear. The pressure and volumetric flow rate of the air stream 274 may be selected such that the air stream 274 effectively clears the measurement area of any fluid or other obstructions of the surrounding environment. In some embodiments, the air stream 274 may be selected, for example, to operate during a measurement operation at a flow rate of about 10 to 50 cubic feet per hour through the air nozzle 72 while maintained at a pressure of about 20 psi to about 70 psi. In some embodiments, the air stream 274 carries sufficient kinetic energy to clear a measurement area on the workpiece surface 215 even while the workpiece surface 215 is otherwise slightly submerged below the surface of a water level maintained in a catcher tank 12 (FIG. 1) supporting the workpiece 214.

Further details of the cutting head 222, including the measurement device 260 and environment control device 270, are described with reference to FIGS. 14 through 22.

Figure 14:
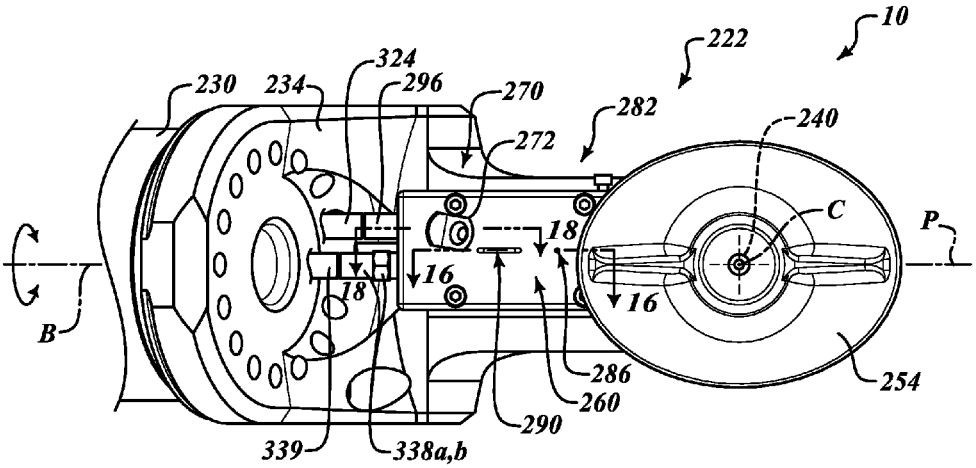
FIG. 14 is a bottom plan view of the cutting head of FIG. 12.

FIG. 14 shows the underside of the cutting head 222 and illustrates, among other things, the positional arrangement of the nozzle 240 with respect to the measurement device 260 and the environment control device 270. As can be appreciated from FIG. 14, the rotational axis B and a centerline of the nozzle 240 of the cutting head 222 define a central reference plane P which essentially bisects the cutting head 222 into opposing halves. The measurement device 260 is positioned such that an operative or sensing portion of the measurement device 260 is offset from this central reference plane P. In this manner, when the cutting head 222 is oriented to align with one of the primary translational axes X, Y of the waterjet cutting system 10 and instructed to cut in the same direction, the sensor 262 is able to obtain positional information without interference from a kerf 277 (FIG. 12) of a cutting operation. In other embodiments, the measurement device 260 may be aligned to act in line with the central reference plane P and the cutting head 222 can be manipulated to avoid positioning a target area of the measurement device over a kerf 277 of a cutting operation. For example, as illustrated in FIG. 12, the cutting head 222 may be instructed to move during a cutting operation in a direction towards the measurement device 260 such that the measurement device 260 leads the cut, rather than trails the cut.

As further shown in FIG. 14, the air nozzle 272 of the environment control device 270 may be mounted to or integrally received in a housing assembly 282 that is spatially separated from the shield 254 of the cutting head 222. In this manner, the air nozzle 272 may be positioned externally of an outer perimeter of the shield 254 when viewing the cutting head 222 from below. In this configuration, the air nozzle 272 may be spaced relatively further from the workpiece surface 215 when the nozzle 240 of the cutting head 222 is positioned at the desired standoff distance 244, as best shown in FIG. 13. For example, in some embodiments a distance 245 between the workpiece surface 15 and a leading edge of the air nozzle 272 may be at least three inches when the nozzle 240 of the cutting head 222 is positioned at the desired standoff distance 244. In this manner, the air nozzle 272 may be less susceptible to damage which may be caused, for example, by potential collisions of the air nozzle 272 with a portion of the workpiece 214, workpiece support fixtures or other structures in the vicinity of the cutting head 222 during operation.

Figure 15:
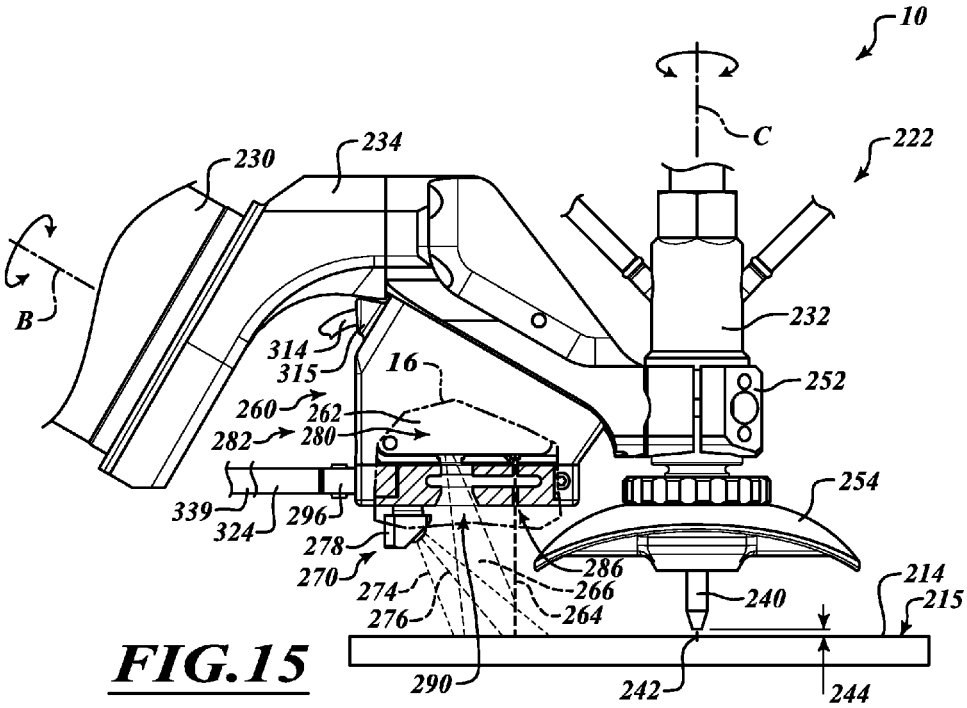
FIG. 15 is a partially broken side elevational view of the cutting head and workpiece of FIG. 12.
Figure 16:
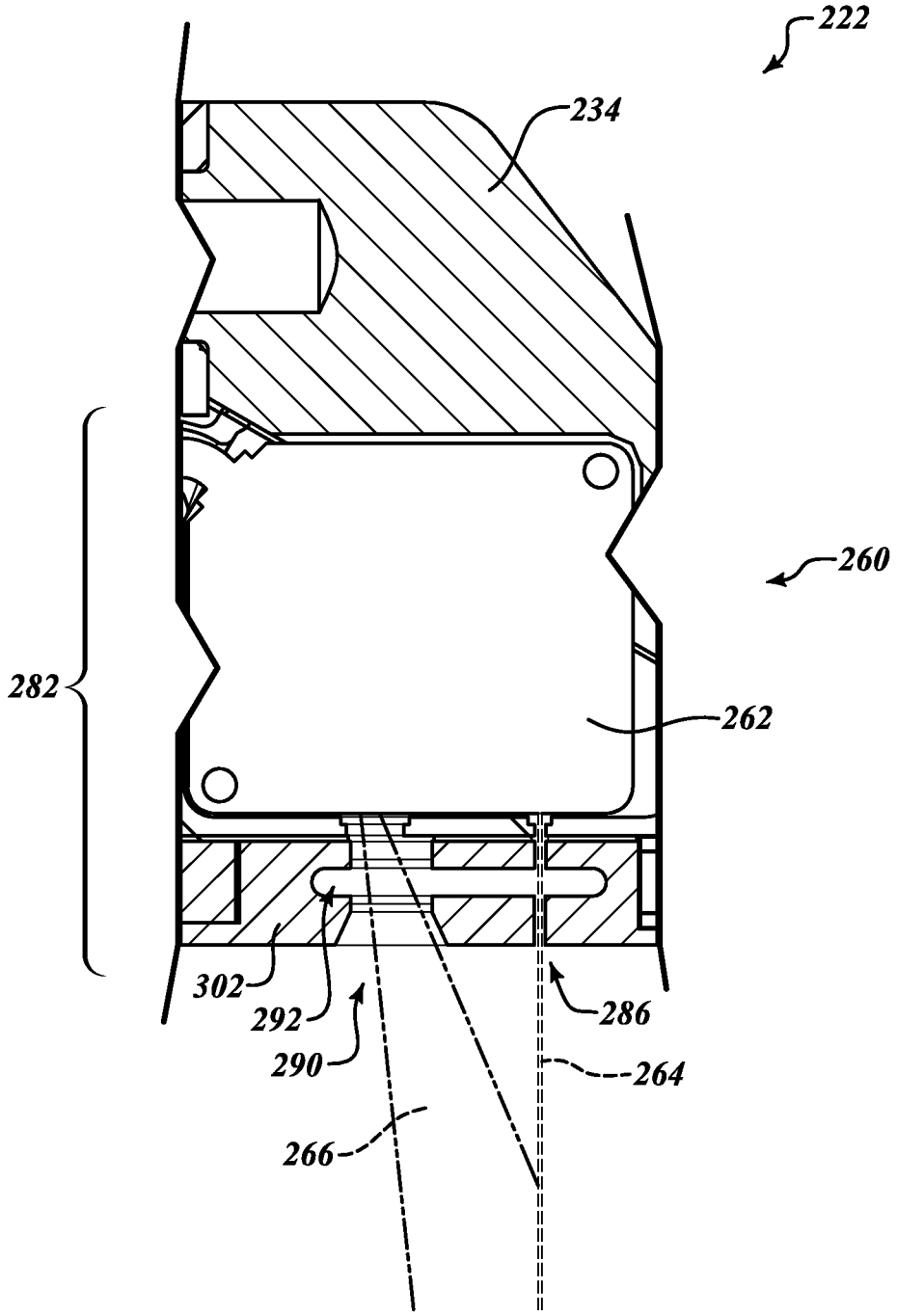
FIG. 16 is an enlarged detail view of a portion of the cutting head of FIG. 12 taken along line 16-16 of FIG. 14.
Figure 17:
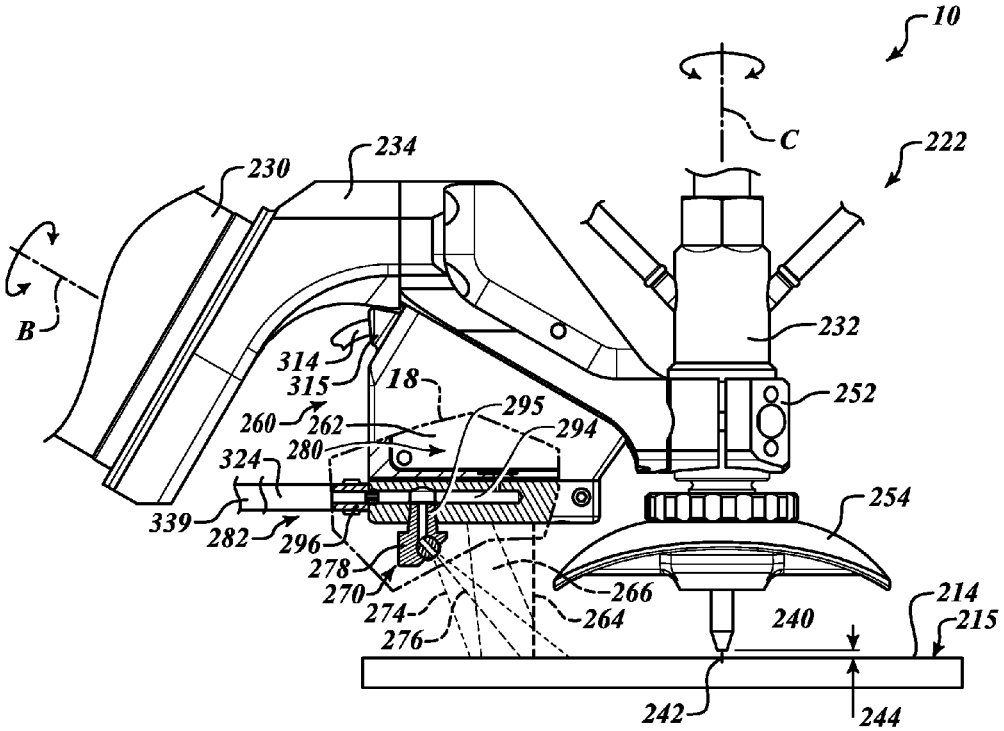
FIG. 17 is a partially broken side elevational view of the cutting head and workpiece of FIG. 12.

FIGS. 15 through 18 illustrate additional features of the measurement device 260 and environment control device 270. For example, the laser displacement sensor 262 of the measurement device 260 is shown received in an internal cavity 280 of the housing assembly 282 which may be secured directly or indirectly to the wrist 234 of the waterjet cutting system 10. The housing assembly 282 may support the sensor 262 in a desired orientation to direct the laser beam 264 selectively emitted therefrom toward the measurement area. In this example embodiment, the sensor 262 is oriented in a generally parallel orientation with respect to the rotational axis C and positioned such that the laser beam 264 passes through a passageway 286 and beside the shield 254, as best shown in FIGS. 15 and 17, to ultimately impinge on the workpiece surface 215 relatively remote from the nozzle 240 of the cutting head 222. As shown in FIG. 16, another passageway 290 is provided in the housing assembly 282 for enabling the detection window of the sensor 262 having a field of view 266 to detect or obtain information related to the impingement of the laser beam 264 on the workpiece surface 215.

With continued reference to FIG. 16, the measurement device 260 may further include a shutter mechanism 292 to selectively isolate the operative or sensing portion of the laser displacement sensor 262 from the external environment of the waterjet cutting system 10. The shutter mechanism 292 may be received within the housing assembly 282 to operate intermediately between the sensor 262 and the workpiece surface 215.

Figure 18:
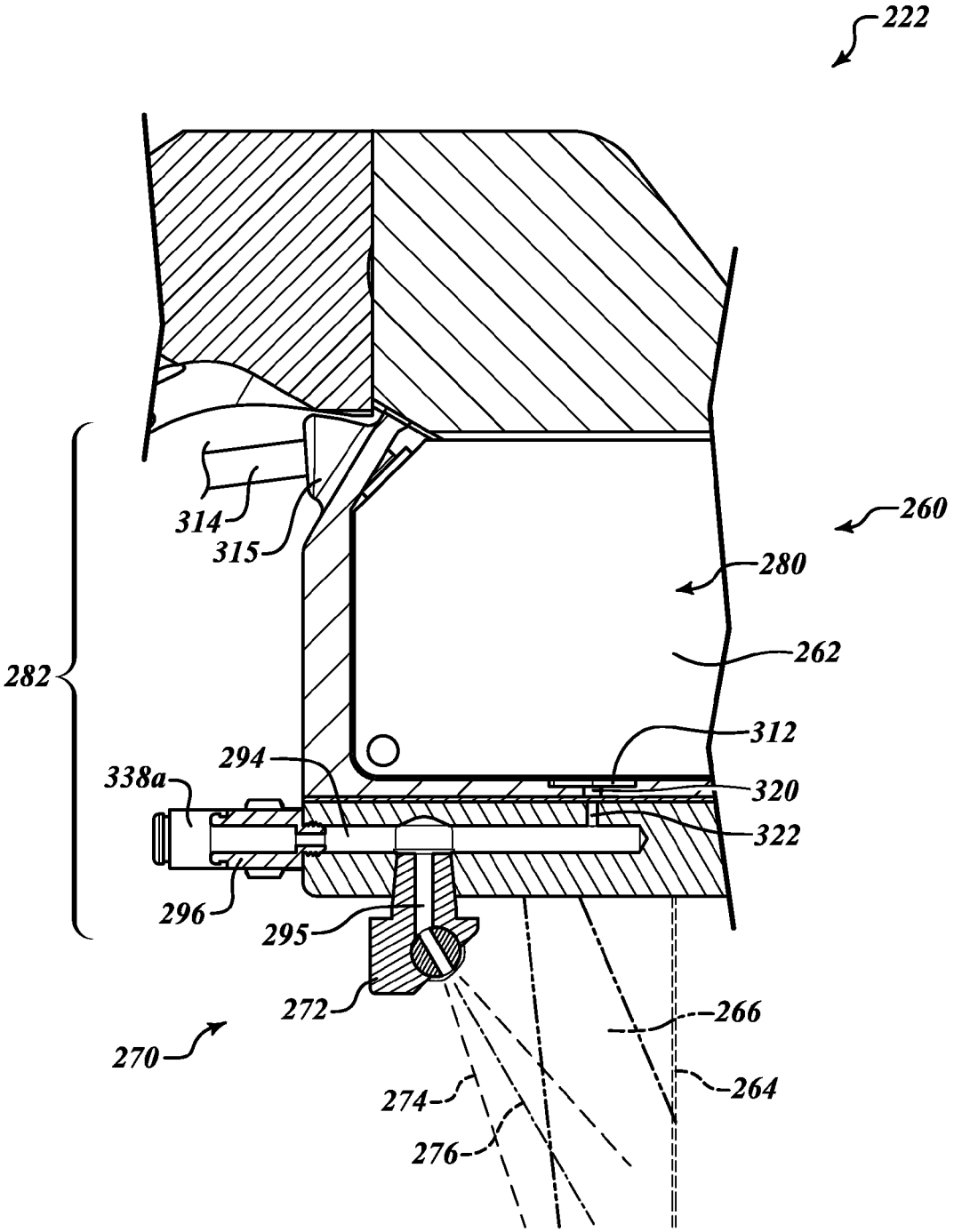
FIG. 18 is an enlarged detail view of a portion of the cutting head of FIG. 12 taken along line 18-18 of FIG. 14.

As shown best in FIGS. 17 and 18, the housing assembly 282 may include a passageway 294 to route air to the air nozzle 272 of the environment control device 270. Conventional fittings 296, adapters and/or couplings may be provided in communication with the passageway 294 to facilitate the connection of a pressurized air source to the passageway 294 to selectively feed air to the air nozzle 272. The passageway 294 may lead partially through the housing assembly 282 and to a passageway 295 in a body of the air nozzle 272. Pressurized air is fed from an external source, through a portion of the housing assembly 282 and ultimately out of the air nozzle 272 of the cutting head 222 and onto the workpiece surface 215.

Further details of the housing assembly 282 and shutter mechanism 292 are described with reference to FIGS. 19 through 22.

Figure 19:
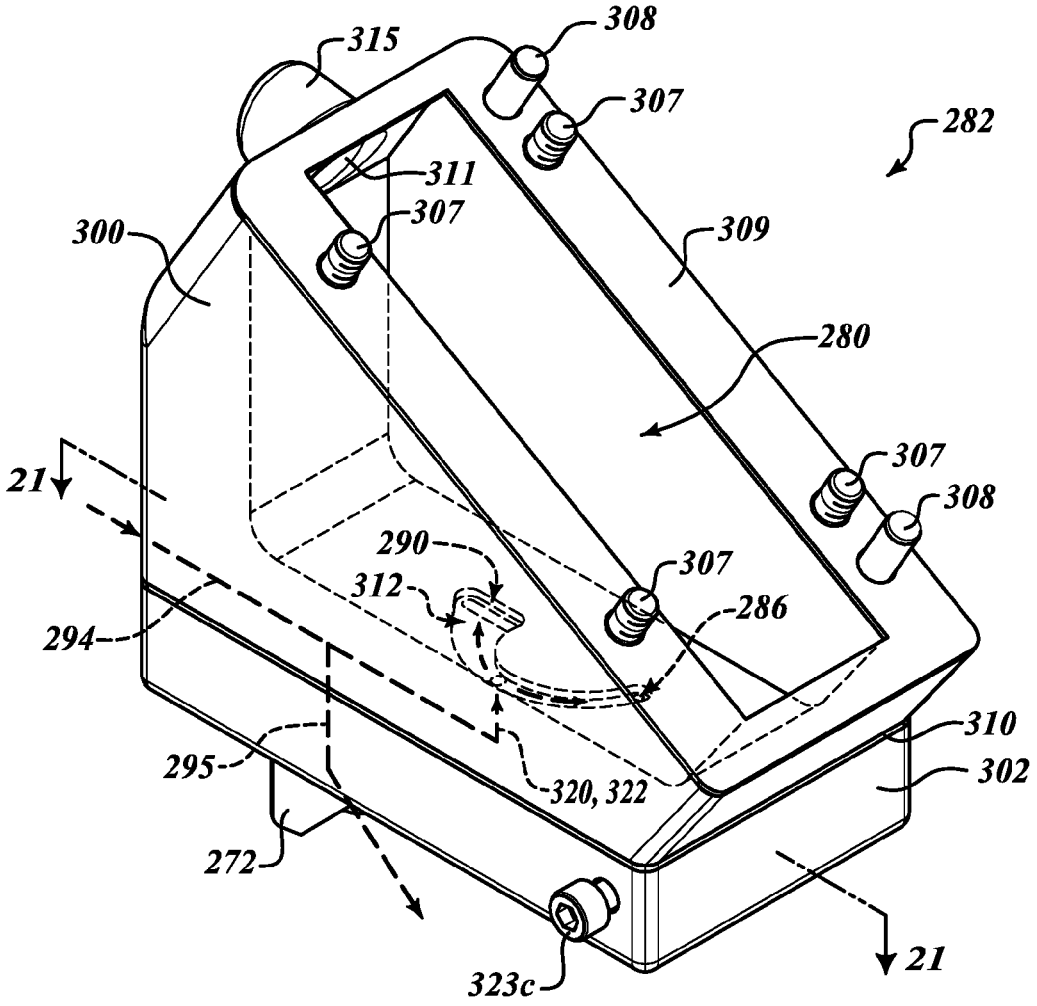
FIG. 19 is an isometric view of a housing assembly of the cutting head of FIG. 12.
Figure 20:
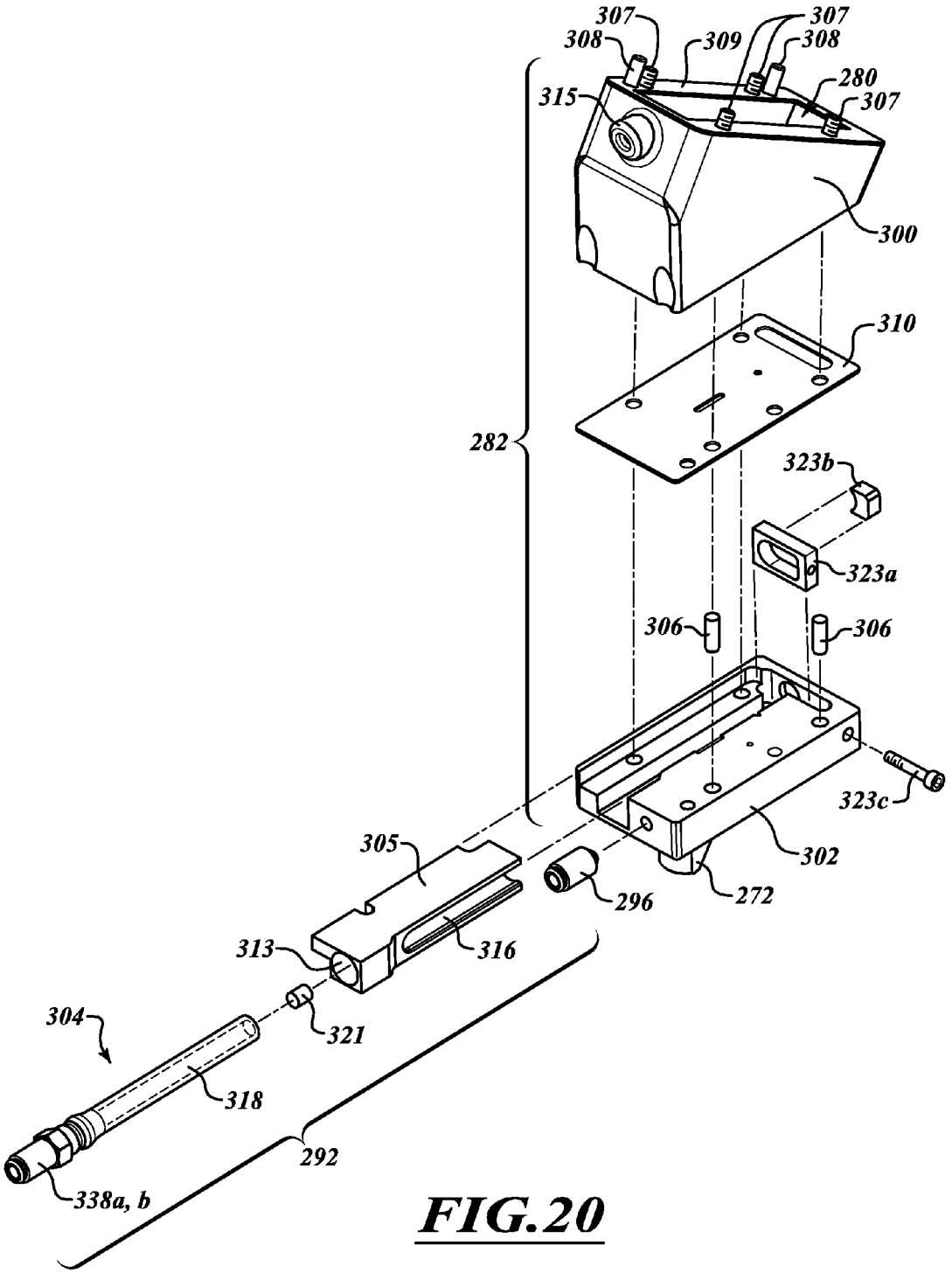
FIG. 20 is an isometric exploded view of the housing assembly of FIG. 19.

FIG. 19 shows the housing assembly 282 in an assembled configuration and FIG. 20 shows the housing assembly 282 in an exploded view. The housing assembly 282 includes an upper housing 300 that is removably coupleable to a lower housing 302. The upper housing 300 and the lower housing 302 may be secured together via conventional fastening devices such as, for example, threaded bolts (not shown) passing through the lower housing 302 and engaging threaded holes in the upper housing 300. Alignment pins 306, 308 or other guides may be provided to maintain an accurate spatial relationship between the components as they are joined together. In a similar fashion, the upper housing 300 may be secured to the wrist 234 of the cutting head system 10 by conventional fastening devices such as, for example, threaded bolts 307 passing through the upper housing 300 and engaging threaded holes in the wrist 234. Alignment pins 306, 308 or other guides may be provided to maintain an accurate spatial relationship between the components as they are joined together. One or more gaskets 309, 310 may be provided to seal mating components of the housing assembly 282 together and to the wrist 234 of the cutting head system 10. In this manner, a substantially sealed internal chamber 312 (FIG. 19) can be established within the housing assembly 282 underlying at least the operational or sensing portion of the sensor 262. This chamber 312 can be pressurized during operation as discussed in more detail below to assist in maintaining a particularly sterile environment around at least the operable or sensing portions of the sensor 262.

As previously discussed the housing assembly 282 includes a cavity 280 to accommodate the sensor 262. Additionally, an aperture 311 may be provided in the housing assembly 282 for routing an electrical cable 314 (FIG. 18) of the sensor 262 external to the housing assembly 282. The cable 314 is electrically coupled to the control system 28 (FIG. 1) such that the control system 28 may receive signals indicative of the information collected during a measurement procedure and adapt the position, orientation and/or trajectory of the cutting head 222 in response to the same to maintain a desired standoff distance 244. A grommet, bushing and/or strain relief 315 (FIG. 18) may be provided in combination with the aperture 311 to guide the cable 314 from the housing assembly 282 and maintain a substantially sealed environment within the housing assembly 282.

As shown in FIG. 18, a passageway 320 may be formed in the upper housing 300 via cross drilling, milling or other known manufacturing and machining techniques. The passageway 320 may align with a corresponding passageway 322 in the lower housing 102 which is ultimately connected to a pressured air source via a feed conduit 324 (FIGS. 12 through 15 and 17). The passageway 320 may be routed such that, during a measurement procedure, the passageway 320 directs an air stream across an operable or sensing portion of the sensor 262 during operation, such as, for example, a detection window of the sensor 262 and/or a laser beam generating portion of the sensor 262. In this manner, pressurized air may be introduced into the chamber 312 to pressurize the same and may flow across operable or sensing portions of the sensor 262 when the shutter mechanism 292 is energized and the shutter 304 actuated to expose the operable or sensing portions of the sensor 262 to the environment. The noted passageways 320, 322 advantageously allow the system 10 to maintain positive pressure in the internal chamber 312 to assist in maintaining a particularly sterile environment, and also provide a mechanism for clearing any debris, vapor or other potential obstructions from the path or paths of the operable or sensing portions of the sensor 262. Accordingly, sensor readings may be acquired in a particularly accurate manner.

Figure 21:
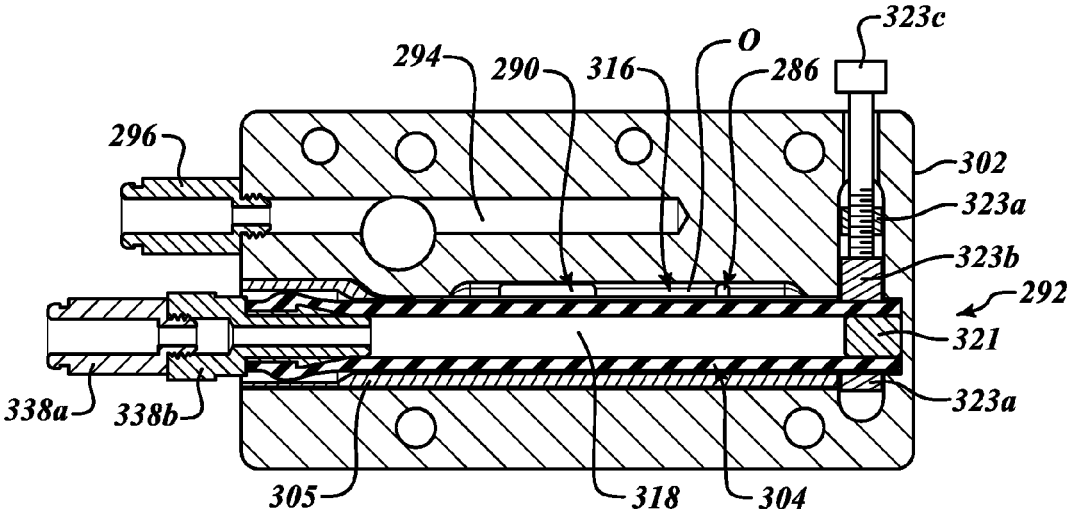
FIG. 21 is a cross-sectional view of a portion of the housing assembly taken along line 21-21 of FIG. 19 with a shutter thereof shown in an open position.
Figure 22:
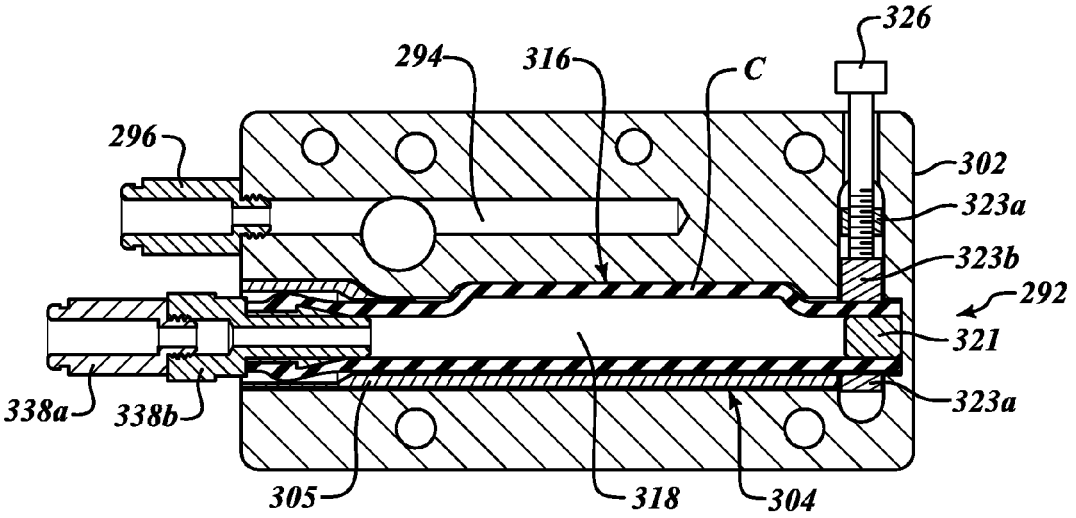
FIG. 22 is a cross-sectional view of a portion of the housing assembly taken along line 22-22 of FIG. 19 with a shutter thereof shown in a closed position.

According to the example embodiment of the shutter mechanism 292 shown best in FIGS. 20 through 22, the shutter mechanism 292 is positioned in the lower housing 302. The shutter mechanism 292 includes a deformable shutter 304 received within a bore or cavity 313 of a sheath 305. The shutter 304 is configured to transition between an open position O, as shown in FIG. 21, and a closed position C, as shown in FIG. 22. The shutter 304 may include, for example, an inflatable tube 318 plugged at one end with a plug 321 and a clamping arrangement 323*a-c*. The inflatable tube 318 may be in communication with a pressurized air source to selectively feed air to the shutter 304 and deform the inflatable tube 318 until it substantially blocks the passageways 286, 290 which would otherwise be unobstructed for enabling the operative or sensing portions of the sensor 262 to obtain information about the position of the cutting head 222. Air may be provided to the inflatable tube 318, for example, by a feed conduit 339 (FIGS. 12 through 15 and 17) and appropriate fittings, couples, or adapters 338*a-b*.

When the shutter 304 is in the open position, the sensor 262 is able to obtain readings through the passageways 286, 290 in the lower housing 302. In the closed position C, the shutter 304 is configured to effectively seal the interior chamber 312 of the housing assembly 282 from the environment of the waterjet cutting system 10 and close off or substantially block the passageways 286, 290. In order to assist in sealing off the chamber 312, the sheath 305 may surround a substantial portion of the inflatable tube 318 of the shutter 304, leaving only a relatively narrow portion unsupported in a region 316 adjacent the passageways 286, 290 in the lower housing 302. In this manner, when the inflatable tube 318 is subjected to sufficient pressure, the inflatable tube 318 deforms only in this limited region 316 to block the passageways 286, 290. Accordingly, the shutter mechanism 292 provides one example of a configuration sufficient to selectively isolate the operative or sensing portions of the measurement device 260 during times when the measurement device 260 might otherwise be subjected to harsh conditions, such as during initial piercing of a workpiece with a waterjet.

Figure 23:
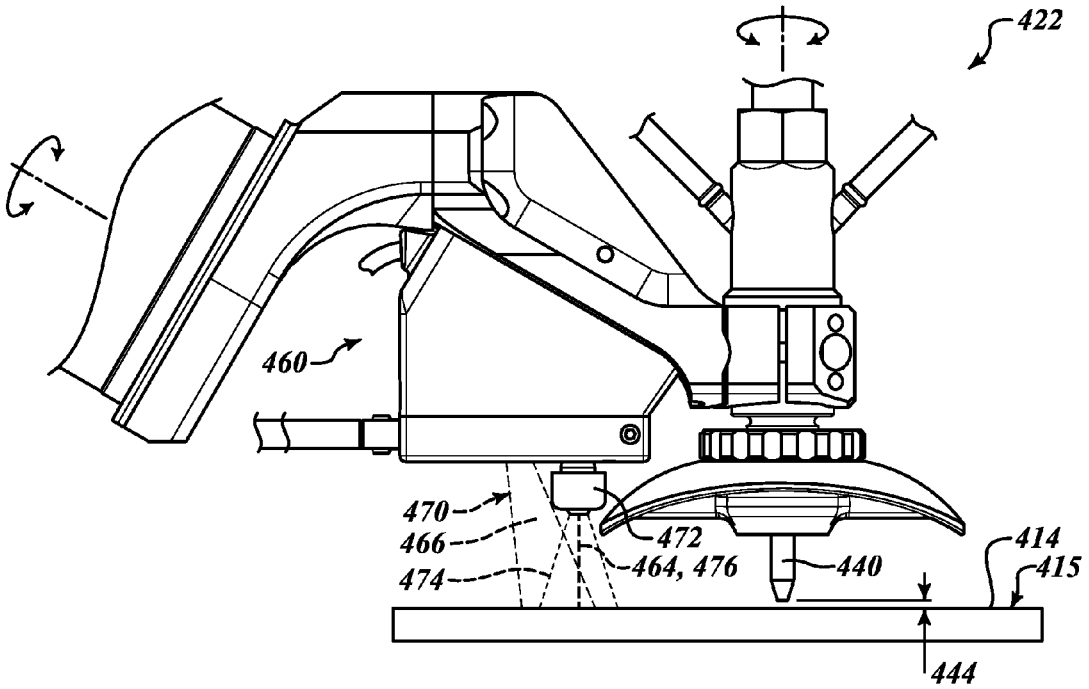
FIG. 23 is a side elevational view of a cutting head, according to yet another embodiment, which is coupleable to a wrist of the waterjet cutting machine of FIG. 1 and shown overlying a workpiece.

FIG. 23 illustrates an alternate embodiment in which an environment control device 470 may interoperate with a measurement device 460 such that a laser beam 464 of the measurement device 460 is substantially collinear with the centerline 476 of an air stream 474 generated by a nozzle 472 of the environment control device 470 during a measurement operation. This may advantageously ensure that a path of the laser beam 464 is reliably free of fluid, vapor, particulate material or other obstructions. Accordingly, particularly accurate and reliable measurements may be obtained to control and optimize a standoff distance 444 of a waterjet nozzle 440 of a cutting head 422 including such an arrangement.

Figure 24:
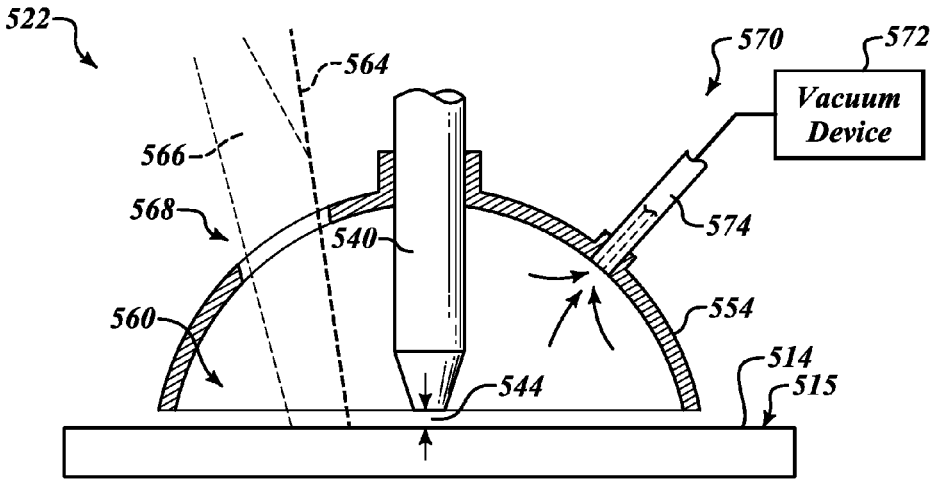
FIG. 24 is a side elevational view of a portion of a cutting head, according to still yet another embodiment, which is coupleable to a wrist of the waterjet cutting machine of FIG. 1 and shown overlying a workpiece.

FIG. 24 illustrates an alternate embodiment in which an environment control device 570 of a cutting head 522 is coupled to a shield 554, in combination with a workpiece surface 515, defines a substantially enclosed space 560 when the nozzle 540 is positioned at a standoff distance 544 from the workpiece 514. The environment control device 570 is coupled to a vacuum device 572 via a conduit 574 and is configured to generate a vacuum to establish a measurement area substantially unobstructed by vapor or other obstructions beneath the shield by evacuating the space 560. An aperture 568 in the shield 554 enables a measurement device (not shown), such as, for example, a laser displacement sensor, to obtain information indicative of the position of the cutting head 522 relative to the workpiece 514. For example, the measurement device may be positioned to selectively generate a laser beam 564 to impinge on the workpiece surface 515 within the measurement area through the aperture 568. Characteristics of the laser beam 564 may be analyzed by the measurement device via a field of view 566 to determine the distance between the measurement device and the workpiece 514 and to detect changes in said distance. In some embodiments, an air nozzle (not shown) may also be provided to concurrently generate a positive air stream in combination with the vacuum to establish the measurement area beneath the shield 554.

Figure 25:
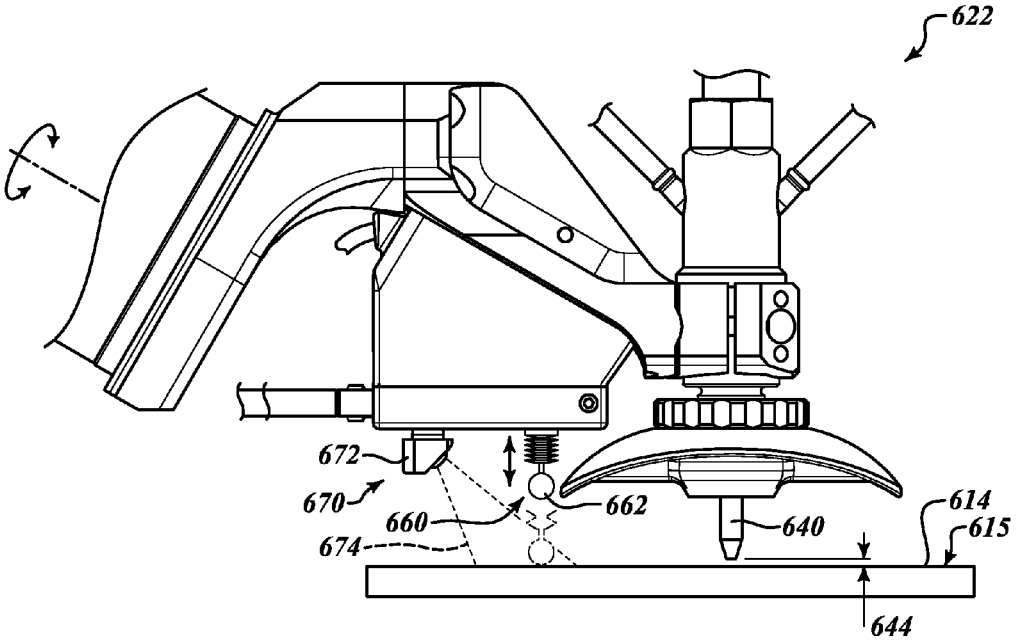
FIG. 25 is a side elevational view of a cutting head, according to still yet another embodiment, which is coupleable to a wrist of the waterjet cutting machine of FIG. 1 and shown overlying a workpiece.

FIG. 25 illustrates yet another alternate embodiment in which a measurement device 660 includes a mechanical probe 662 that is movable to selectively probe the surface 615 of the workpiece 614 within a measurement area generated by an air nozzle 672 of an environment control device 670. The probe 662 may be configured to move from a retracted position toward the workpiece surface 615 to selectively obtain information indicative of a position of a tip of a nozzle 640 of the cutting head 622 relative to the workpiece 614. In some embodiments, the probe 662 may contact the workpiece surface 615, and in other embodiments, may include proximity sensors or other sensors to obtain positional information in a non-contact manner. In the retracted position, the probe 662 may be positioned so as to not substantially interfere with operational movements of the cutting head 622 during cutting operations.

Figure 26:
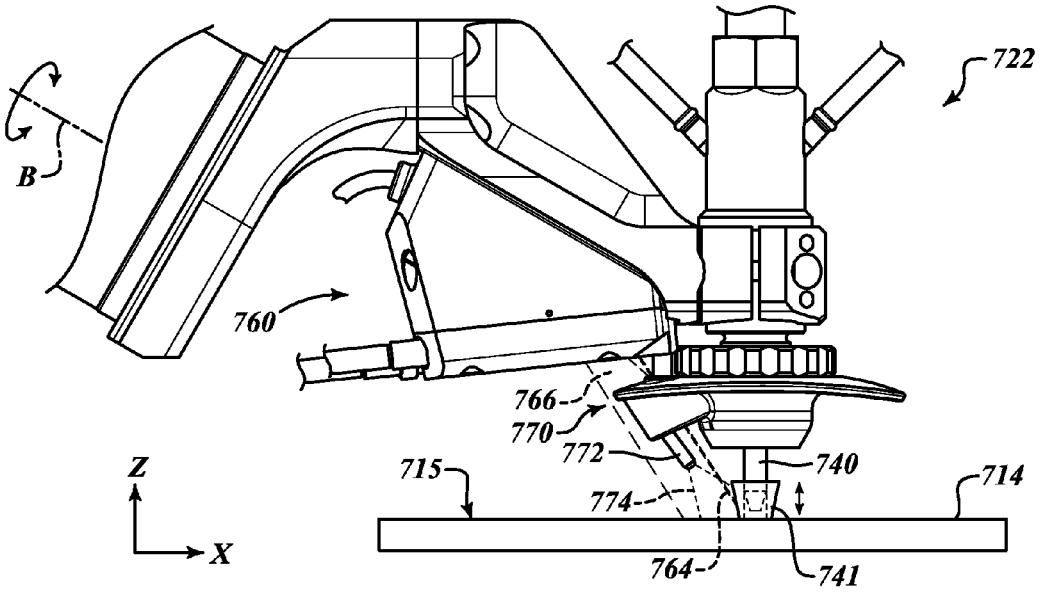
FIG. 26 is a side elevational view of a cutting head, according to still yet another embodiment, which is coupleable to a wrist of the waterjet cutting machine of FIG. 1 and shown overlying a workpiece.

FIG. 26 illustrates another embodiment in which a probe 741 is movably coupled to a cutting head 722 and positioned to contact the surface 715 of a workpiece 714 during a measurement operation. In the illustrated embodiment of FIG. 26, the probe 741 is shown as a truncated cone slidably coupled to the nozzle 740 of the cutting head 722. During operation, the probe 741 displaces in response to changes in the height of the surface 715 of the workpiece 714 as the cutting head 722 moves over the surface 715. A measurement device 760 includes a laser displacement sensor (not shown) that is positioned such that a laser beam 764 selectively generated by the sensor impinges on a surface of the probe 741 during the measurement operation. The laser displacement sensor is configured to obtain information relating to a change in the position of the probe 741 within a field of view 766 of the measurement device 760. This information is in turn indicative of a change in the standoff distance between the nozzle 740 and the surface 715 of the workpiece 714. Accordingly, by sensing displacements of the probe 741 and manipulating the nozzle 740 in response thereto, the nozzle 740 of the cutting head 722 may be maintained at a substantially constant standoff distance. In some embodiments, measurements may be taken within a measurement area established by an air stream 774 generated by an air nozzle 772 of an environment control device 770. In other embodiments, measurements may be taken in the absence of an air stream 774 generated by air nozzle 772 the environment control device 770. In some embodiments, measurements may be taken during a cutting operation, and in other embodiments, measurements may be taken while the cutting head 722 is not cutting.

The various features and aspects described herein provide waterjet cutting systems that are particularly well suited for processing workpieces in a highly accurate manner and include versatile cutting heads with compact form factors to enable, among other things, efficient cutting of workpieces having non-planar profiles.

Although embodiments are shown in the Figures in the context of processing generic plate-like workpieces, it is appreciated that the cutting heads and waterjet cutting systems incorporating the same described herein may be used to process a wide variety of workpieces having simple and complex shapes, including both planar and non-planar structures. Further, as can be appreciated from the above descriptions, the cutting heads and waterjet cutting systems described herein are specifically adapted to control the standoff distance between a cutting head nozzle and a workpiece that is being processed. This can be particularly advantageous when cutting, for example, large flat plates which typically bow over a length thereof. The systems described herein can adapt to bowing by tracing the contour of the plates with measurement devices in areas that are conditioned to be clear of obstructions during the cutting operation or prior to the cutting operation.

For example, in some embodiments, a measurement operation may be executed while moving along a desired cutting path prior to a cutting operation to construct a "workpiece profile" which represents the actual surface profile of a workpiece in the coordinate system of the waterjet cutting machine within a relatively small tolerance range. This workpiece profile can be generated, for example, by sensing the surface of the workpiece continuously or intermittingly during the measurement operation and storing surface data for subsequent cutting operations. The frequency with which measurements are taken may be adjusted to increase or decrease the relative accuracy of the workpiece profile. Once obtained, the workpiece profile may be used to generate movements of the cutting head relative to the workpiece to maintain the tip of the nozzle at a constant standoff distance from the surface of the workpiece. In this manner, a desired path of the tip of the nozzle corresponding to a selected standoff distance from the workpiece may be "pre-mapped" prior to cutting. During such pre-mapping, measurements may be taken with or without the environment control device acting on the workpiece surface depending on, for example, the presence of water, vapor or other obstructions.

In other instances, readings may be taken during a cutting operation (continuously or intermittingly) to provide highly accurate contour following while cutting is occurring. In instances where readings are taken intermittingly throughout a cutting operation, readings may be taken with greater or less frequency to manipulate the accuracy with which the standoff distance may be maintained. In other embodiments, the readings may be taken only during intervals when cutting is not occurring, such as, for example, just prior to piercing a workpiece to begin a cut or in an interval between successive cuts. Again, measurements may be taken with or without the environment control device acting on the workpiece surface depending on, for example, the presence of water, vapor or other obstructions.

Figure 27:
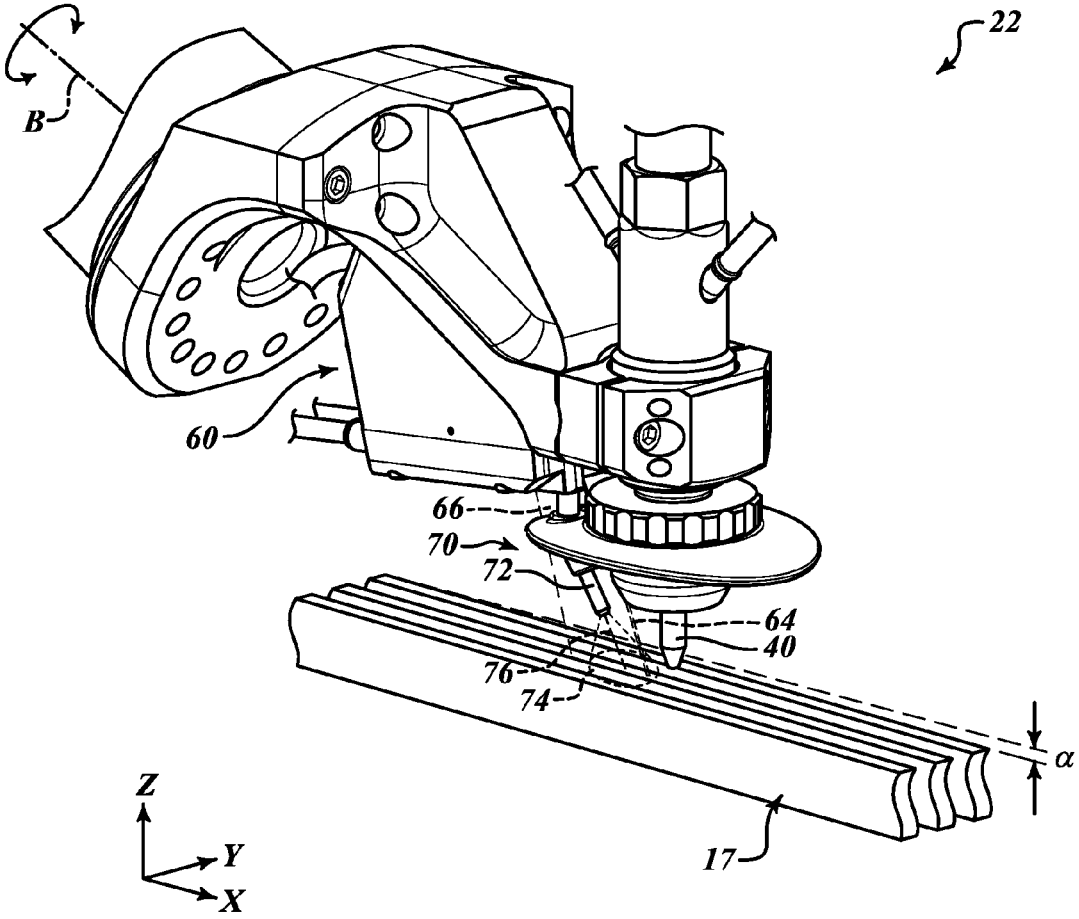
FIG. 27 is an isometric view of the cutting head of FIG. 2 shown overlying a portion of a workpiece support structure.

Still further, although many embodiments are shown in the Figures in the context of measuring and establishing desired standoff distances with respect to a workpiece surface, it is appreciated that the cutting heads and waterjet cutting systems incorporating the same described herein may be used to generate measurement areas on the surface of a workpiece support structure from which to gather information indicative of a position of the cutting head relative to the workpiece support structure. This information can in turn be used to determine whether the workpiece support structure is level within an acceptable tolerance range and to make corrections to the same. For example, with reference to FIG. 27, in some embodiments, the workpiece support structure may include a series of slats which collectively define a workpiece platform 17 to support a workpiece during cutting operations. In such embodiments, the slats may be leveled based at least in part on positional information obtained from within a measurement area generated on surfaces of the slats. For instance, a laser beam 64 of a measurement device 60 may impinge on the surface of the slats which define the workpiece platform 17. The cutting head 22 may then be moved along or across the slats within an X-Y reference plane of the waterjet cutting system while collecting information relating to changes in distance between the cutting head 22 and the platform 17. This data may be used to determine if the slats are level, and if not, the degree to which the slats may need to be adjusted to align with the X-Y reference plane. Adjustments may be made manually or automatically to level the platform 17, such as, for example, by making angular adjustments to the slats, as represented in FIG. 27 by the angle $\alpha$. In some embodiments, measurements may be taken within a measurement area established by an air stream 74 generated by an air nozzle 72 of an environment control device 70. In other embodiments, measurements may be taken in the absence of an air stream 74 generated by the environment control device 70.

Figure 28:
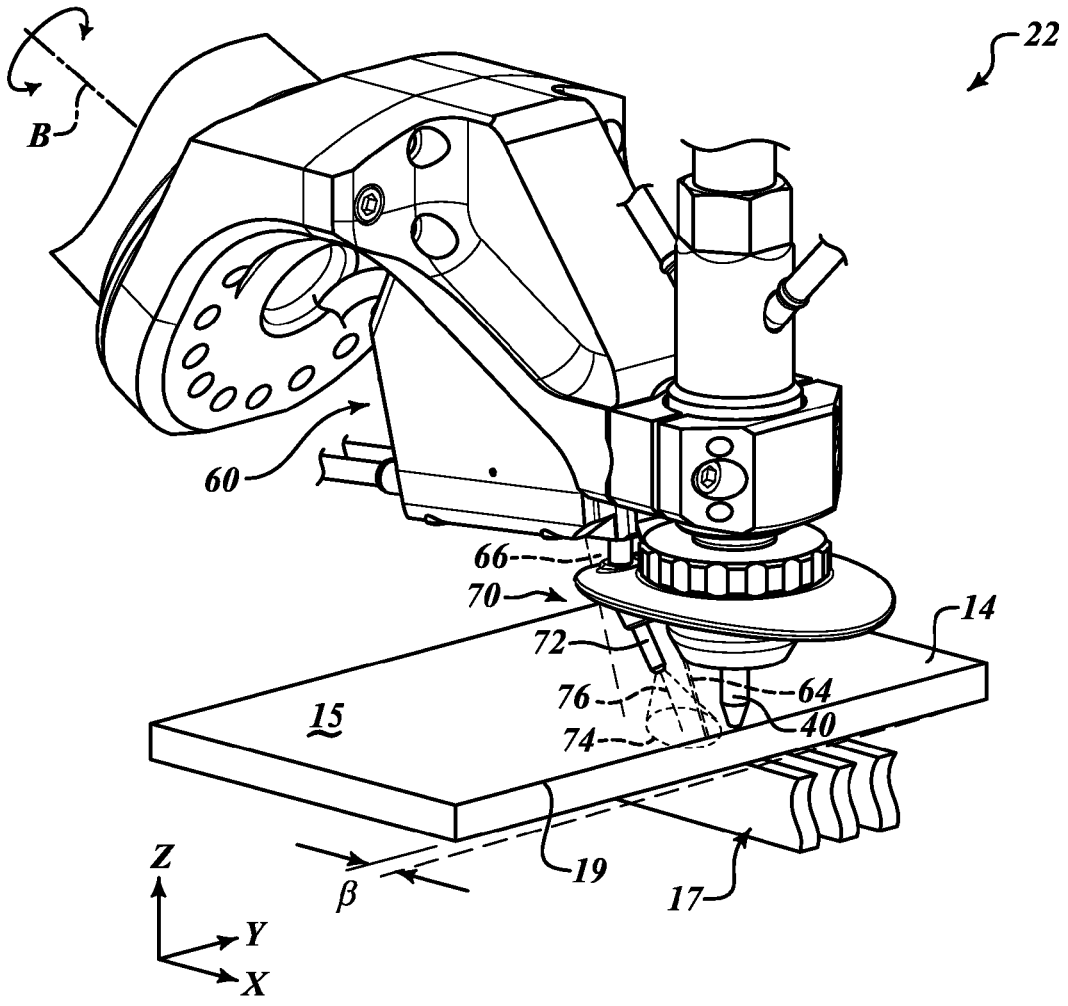
FIG. 28 is an isometric view of the cutting head of FIG. 2 shown overlying a workpiece and a portion of a workpiece support structure.

Additionally, the cutting heads and waterjet cutting systems incorporating the same described herein may be used to detect edges of a workpiece or other features on the workpiece for various purposes. For example, according to some embodiments, a workpiece 14 may be repositioned after detecting the orientation of an edge 19 thereof with respect to a coordinate system of the waterjet cutting system, as illustrated in FIG. 28. More particularly, the edge 19 of the workpiece 14 may be located by sensing a substantial change in readings from a laser beam 64 of the measurement device 60 as the laser beam 64 crosses the edge 19 and transitions from impinging on the workpiece surface 15 to a surface of a platform 17 underlying the workpiece 14 or another structure. Several locations along the edge 19 may be scanned with the laser beam 64 to gather several reference points along the edge 19 from which to calculate the orientation of the same. With this information, the workpiece 14 may then be manually or automatically repositioned to align the edge 19 with a coordinate axis of the coordinate system, such as, for example, by rotating the workpiece 14 by a corrective amount, as illustrated by the angle labeled $\beta$. In some embodiments, measurements may be taken within a measurement area established by an air stream 74 generated by an air nozzle 72 of an environment control device 70. In other embodiments, measurements may be taken in the absence of an air stream 74 generated by the environment control device 70.

As another example, similar measurement operations may be carried out to determine whether the cutting head 22 is overlying a workpiece 14 prior to initiating a cutting operation (i.e., before generating a fluid jet and piercing the workpiece 14). For example, the control system may be configured to determine whether the laser beam 64 is impinging on a surface beyond the workpiece by comparing a measurement reading of the laser beam 64 with an expected measurement reading based on, for example, the thickness of a selected workpiece for processing. When there is a significant discrepancy between a reading and the expected reading corresponding to the expected location of a workpiece surface 15, the control system may deactivate, disable or lockout the waterjet cutting system from initiating a cutting operation. Accordingly, inadvertent cutting beyond the perimeter of a workpiece 14 may be advantageously prevented.

In a similar fashion, embodiments described herein may be configured to distinguish between readings obtained from uncut target areas on a workpiece and areas that have pre-cut kerfs or other surface irregularities or characteristics. For example, for relatively planar workpieces, the measured distance between the cutting head and the workpiece should fall within a relatively small tolerance range of an expected value over the entire surface of the workpiece. Accordingly, when a reading deviates beyond this tolerance range over a relatively short distance consistent with a kerf, the operating system may treat the reading as an anomaly and disregard it. In other embodiments, the control system may store information pertaining to the location of kerfs of prior cuts and adjust a cutting path of the cutting head to avoid impinging the laser beam of the measurement device on such features. In this manner, the measurement device and control system may be configured to maintain a particularly accurate standoff distance without regard to discontinuities or irregularities in the surface of the workpiece.

Moreover, the various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A cutting head of a waterjet cutting system, the cutting head comprising:

a nozzle having an orifice through which fluid passes during operation to generate a high-pressure fluid jet for processing a workpiece;

an environment control device positioned to act on a surface of the workpiece at least during a measurement operation, the environment control device configured to establish a measurement area on the surface of the workpiece via a discharged fluid stream or suction; and a measurement device positioned relative to the environment control device to selectively obtain information from within the measurement area with a laser beam dischargeable by the measurement device to impinge on the workpiece, the obtained information being indicative of a position of a tip of the nozzle of the cutting head relative to the workpiece.

2. The cutting head of claim 1, further comprising:

a wrist manipulable in space to position and orient the nozzle relative to the workpiece, and wherein the environment control device and the measurement device are positioned on the wrist to move in unison with the nozzle.

3. The cutting head of claim 2 wherein an axis of the nozzle and a rotational axis of the wrist define a reference plane, and wherein the measurement device is positioned to selectively obtain information in a location offset from the reference plane.

4. The cutting head of claim 1 wherein the environment control device is configured to selectively generate an air stream, a centerline of the air stream oriented to intersect a path of the laser beam at a position below the surface of the workpiece.

5. The cutting head of claim 1 wherein the environment control device is configured to selectively generate an air stream, a centerline of the air stream oriented to impinge on the surface of the workpiece within the measurement area at a position aft of a path of the laser beam and to flow across the path of the laser beam during the measurement operation.

6. The cutting head of claim 1 wherein the environment control device is configured to selectively generate an air stream such that a centerline of the air stream and a path of the laser beam define an acute angle.

7. The cutting head of claim 1 wherein the laser beam is oriented parallel to a centerline of the nozzle.

8. The cutting head of claim 1 wherein the cutting head operates within a surrounding waterjet cutting environment, and wherein the environment control device is configured to establish the measurement area on the surface of the workpiece such that the measurement area is unobstructed by fluid, vapor or particulate material of the surrounding waterj et cutting environment.

9. The cutting head of claim 1, further comprising:

a shield to protect portions of the cutting head and surrounding components during operation, the environment control device passing through a portion of the shield.

10. The cutting head of claim 9 wherein the environment control device is configured to generate a vacuum to establish the measurement area beneath the shield by evacuating a space generally enclosed by the shield and the surface of the workpiece.

11. The cutting head of claim 9 wherein the environment control device is configured to generate an air stream to establish the measurement area beneath the shield.

12. The cutting head of claim 9 wherein the measuring device is configured to selectively generate the laser beam to pass through a void in the shield.

13. The cutting head of claim 1, further comprising:

a shutter mechanism configured to selectively isolate an operative portion of the measurement device from a surrounding environment of the waterjet cutting system.

14. The cutting head of claim 13 wherein the shutter mechanism includes a shutter movable between an open position and a closed position, the shutter isolating the operative portion of the measurement device from the surrounding environment when in the closed position and enabling the measurement device to obtain the information indicative of the position of the tip of the nozzle of the cutting head relative to the workpiece when in the open position.

15. The cutting head of claim 14 wherein the shutter is movably coupled to a linear actuator for selectively moving the shutter between the open position and the closed position.

16. The cutting head of claim 14 wherein the shutter is a deformable member coupled to a pressure generating source for selectively transitioning the shutter between the open position and the closed position.

17. The cutting head of claim 14 wherein the shutter is positioned in a housing to selectively isolate an internal cavity of the housing from the surrounding environment, the housing including a passageway to route pressurized air into the internal cavity.

18. The cutting head of claim 17 wherein the passageway is oriented to route pressurized air into the internal cavity of the housing across a face of an operable portion of the measurement device.

19. The cutting head of claim 17 wherein the passageway is connected to another passageway configured to feed pressurized air to the environment control device, and wherein, when pressurized air is fed to the environment control device to generate an air stream, pressurized air is simultaneously fed to the internal cavity of the housing.

20. The cutting head of claim 14 wherein the shutter is positioned in a housing to selectively isolate an internal cavity of the housing from the surrounding environment, and wherein the shutter is biased toward the housing.

21. A waterjet cutting system, comprising:

a cutting head having a nozzle with an orifice through which fluid passes during operation to generate a high-pressure fluid jet for processing a workpiece;

an environment control device positioned to act on a surface of the workpiece at least during a measurement operation, the environment control device configured to establish a measurement area on the surface of the workpiece via a discharged fluid stream or suction;

a measurement device positioned to selectively obtain information from within the measurement area with a laser beam dischargeable by the measurement device to impinge on the workpiece, the obtained information being indicative of a position of a tip of the nozzle of the cutting head relative to the workpiece; and a control system to move the cutting head relative to the workpiece, the control system operable to position the tip of the nozzle of the cutting head relative to the workpiece at a standoff distance based at least in part on the information indicative of the position of the tip of the nozzle of the cutting head obtained from the measurement device.

22. The waterjet cutting system of claim 21 wherein the control system is configured to filter out information obtained by the laser beam from target areas of the workpiece having pre-cut kerfs and to use information indicative of the tip of the nozzle of the cutting head relative to the workpiece only from uncut target areas of the workpiece when calculating the standoff distance.

23. The waterjet cutting system of claim 21 wherein the cutting head operates within a surrounding waterjet cutting environment, and wherein the environment control device is configured to establish the measurement area on the surface of the workpiece such that the measurement area is unobstructed by fluid, vapor or particulate material of the surrounding waterjet cutting environment.

24. The waterjet cutting system of claim 21 wherein the measurement device is configured to feed the obtained information to the control system to manipulate the nozzle of the cutting head during a cutting operation based at least in part on the obtained information.

25. The waterjet cutting system of claim 21 wherein the control system is configured to determine whether the laser beam is impinging on a surface beyond the workpiece by comparing a measurement reading of the laser beam with an expected measurement reading.

26. The waterjet cutting system of claim 21, further comprising:

a wrist manipulable in space to position and orient the cutting head relative to the workpiece, and wherein the environment control device and the measurement device are positioned on the wrist to move in unison with the cutting head.

27. The waterjet cutting system of claim 21 wherein the environment control device is configured to selectively generate an air stream, a centerline of the air stream oriented to impinge on the measurement area at a position aft of a path of the laser beam and to flow across the path of the laser beam during the measurement operation.

28. The waterjet cutting system of claim 21, further comprising:

a shield to protect portions of the cutting head and surrounding components during operation, the environment control device passing through a portion of the shield.

29. The waterjet cutting system of claim 28 wherein the environment control device is configured to generate a vacuum to establish the measurement area beneath the shield by evacuating a space generally enclosed by the shield and the surface of the workpiece.

30. The waterjet cutting system of claim 28 wherein the environment control device is configured to generate an air stream to establish the measurement area beneath the shield.

31. The waterjet cutting system of claim 21, further comprising:

a shutter mechanism configured to selectively isolate an operative portion of the measurement device from a surrounding environment of the waterjet cutting system.

32. A method of operating a waterjet cutting system having a cutting head, the method comprising:

activating an environment control device of the cutting head to act on a surface of a workpiece to establish a measurement area on the surface of the workpiece via a discharged fluid stream or suction; and obtaining information from within the measurement area indicative of a position of the cutting head relative to the workpiece with the assistance of a laser beam impinging on the workpiece within the measurement area.

33. The method of claim 32, further comprising:

optimizing a standoff distance between a tip of a nozzle of the cutting head and the workpiece.

34. The method of claim 33 wherein optimizing the standoff distance between the tip of the nozzle of the cutting head and the workpiece includes obtaining the information from within the measurement area indicative of the position of the cutting head intermittingly during a cutting operation, and manipulating the cutting head based at least in part on the information.

35. The method of claim 33 wherein optimizing the standoff distance between the tip of the nozzle of the cutting head and the workpiece includes obtaining the information from within the measurement area indicative of the position of the cutting head continuously during a cutting operation, and manipulating the cutting head based at least in part on the information.

36. The method of claim 32 wherein obtaining information from within the measurement area indicative of the position of the cutting head relative to the workpiece includes utilizing the laser beam to sense a distance between a reference point and the surface of the workpiece.

37. The method of claim 32 wherein activating the environment control device coupled to the cutting head to act on the surface of the workpiece includes generating an air stream to impinge on the surface of the workpiece.

38. The method of claim 32 wherein activating the environment control device coupled to the cutting head to act on the surface of the workpiece includes creating a vacuum to evacuate a space overlying the surface of the workpiece.

39. The method of claim 32, further comprising:

prior to obtaining information from within the measurement area indicative of the position of the cutting head relative to the workpiece, actuating a shutter mechanism to expose the measurement area to a measurement device coupled to the cutting head.

40. The method of claim 39, further comprising:

pressurizing an internal cavity that is selectively isolated by the shutter mechanism from a surrounding environment.

41. The method of claim 39 wherein actuating the shutter mechanism includes energizing an actuator to move a shutter of the shutter mechanism from a closed position to an open position.

42. The method of claim 39 wherein actuating the shutter mechanism includes temporarily deforming a shutter of the shutter mechanism to transition the shutter from a closed position to an open position.

43. The method of claim 32, further comprising:

routing pressurized air across a face of an operable portion of a measurement device used to obtain the information from within the measurement area.

44. The method of claim 43, further comprising:

routing pressurized air to the environment control device while routing the pressurized air across the face of the operable portion of the measurement device.

45. The method of claim 32, further comprising:

constructing a workpiece surface profile prior to a cutting operation based at least in part on information obtained via the laser beam impinging on the surface of the workpiece.

46. The method of claim 45 wherein constructing the workpiece surface profile includes sensing a distance between the workpiece and the cutting head at a plurality of locations along a cutting path prior to cutting the workpiece.

47. The method of claim 32, further comprising:

detecting an edge of the workpiece by moving the cutting head across the edge and comparing positional information obtained from the laser beam impinging on the surface of the workpiece and positional information obtained from the laser beam impinging off of the surface of the workpiece.

48. The method of claim 47, further comprising:

aligning the edge of the workpiece with a coordinate axis of a coordinate system of the waterjet cutting system after detecting the edge of the workpiece.

49. The method of claim 32 wherein the cutting head operates within a surrounding waterjet cutting environment, and further comprising:

clearing the measurement area on the surface of the workpiece such that the measurement area is unobstructed by fluid, vapor or particulate material of the surrounding waterjet cutting environment.

50. A method of operating a waterjet cutting system having a cutting head, the method comprising:

activating an environment control device of the cutting head to act on a surface of a workpiece support structure to establish a measurement area on the surface of the workpiece support structure via a discharged fluid stream or suction; and obtaining information from within the measurement area indicative of a position of the cutting head relative to the workpiece support structure with the assistance of a laser beam.

51. The method of claim 50, further comprising:

leveling the workpiece support structure based at least in part on the information obtained from within the measurement area indicative of the position of the cutting head relative to the workpiece support structure.

* * * * *

UNITED STATES PATENT AND TRADEMARK OFFICE

CERTIFICATE OF CORRECTION

PATENT NO. : 9,003,936 B2
APPLICATION NO. : 13/194579
DATED : April 14, 2015
INVENTOR(S) : Alex M. Chillman et al.

It is certified that error appears in the above-identified patent and that said Letters Patent is hereby corrected as shown below:

Claims

Column 23, Line 61, Claim 8:
"vapor or particulate material of the surrounding waterj et" should read --vapor or particulate material of the surrounding waterjet--.

Signed and Sealed this
Eighth Day of December, 2015

Michelle K. Lee

Michelle K. Lee
*Director of the United States Patent and Trademark Office*